US006566302B1

(12) United States Patent
Taylor et al.

(10) Patent No.: US 6,566,302 B1
(45) Date of Patent: May 20, 2003

(54) MONOPHASE SOLID SOLUTIONS COMPRISING A PLURALITY OF COLOR FORMER COMPOUNDS AND PROCESS FOR THEIR PREPARATION

(75) Inventors: James Philip Taylor, Macclesfield (GB); Michael Heneghan, Rheinfelden-Adelhausen (DE)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/763,737

(22) PCT Filed: Aug. 10, 1999

(86) PCT No.: PCT/EP99/05803

§ 371 (c)(1),
(2), (4) Date: Feb. 26, 2001

(87) PCT Pub. No.: WO00/12318

PCT Pub. Date: Mar. 9, 2000

(30) Foreign Application Priority Data

Aug. 29, 1998 (GB) ..... 9818821

(51) Int. Cl.[7] ..... B41M 5/136; B41M 5/145; B41M 5/30

(52) U.S. Cl. ..... 503/218; 106/31.16; 106/31.2; 106/31.21; 106/31.22; 503/220; 503/221; 549/224

(58) Field of Search ..... 106/31.16, 31.2, 106/31.21, 31.22; 503/218, 220, 221; 549/224

(56) References Cited

U.S. PATENT DOCUMENTS

| | | | | |
|---|---|---|---|---|
| 5,063,097 A | | 11/1991 | Hirota et al. | 428/65 |
| 5,719,016 A | | 2/1998 | Christian et al. | 430/530 |
| 5,756,746 A | * | 5/1998 | Hao et al. | 546/56 |

FOREIGN PATENT DOCUMENTS

| | | |
|---|---|---|
| EP | 0102132 | 3/1984 |
| EP | 0704496 | 4/1996 |
| EP | 0794235 | 9/1997 |

OTHER PUBLICATIONS

Derwent Abstr. AN 1984–173488 for JP 59094733 (1984).

* cited by examiner

*Primary Examiner*—Bruce H. Hess
(74) *Attorney, Agent, or Firm*—Kevin T. Mansfield

(57) ABSTRACT

A monophase solid solution comprising a plurality of color formers selected from the group consisting essentially of the fluoran type, phthalide type, phenoxazine type, phenothiazine type, rhodamine lactam type, leuco-auramine type, triphenylmethane type, spiropyran type, benzoxazine type, quinazoline type of color formers and mixtures thereof, preferably wherein the color forming materials are selected from the fluoran and phthalide type of color former and mixtures thereof.

12 Claims, 4 Drawing Sheets

Physical mixture of 3-N-propyl-N-methylamino-6-methyl-7-anilinofluoran(90mol%) and 3-Diethylamino-6-methyl-7-anilinofluoran (10mol%)

Monophase solid solution of example 21

MONOPHASE SOLID SOLUTIONS COMPRISING A PLURALITY OF COLOR FORMER COMPOUNDS AND PROCESS FOR THEIR PREPARATION

TECHNICAL FIELD

The present invention relates to monophase solid solutions which are useful as colour forming compounds in recording materials. More particularly, the invention relates to a monophase solid solution comprising a plurality of colour former compounds, processes for their preparation and to the use of monophase solid solutions as colour formers in recording materials such as heat sensitive and pressure sensitive recording materials.

DESCRIPTION OF THE PRIOR ART

Pressure sensitive recording, heat sensitive recording and electroheat sensitive recording have conventionally been used as systems for recording transferred information through the mediation of external energy, such as pressure, heat or electricity, by utilising a colour reaction between a colourless or pale coloured electron donative compound (colour forming compound) and an organic or inorganic electron acceptor (developer).

In such recording systems, mixtures of more than one colour former have been used as the colour forming compound. For example, U.S. Pat. No. 4,226,912 discloses a system wherein the chromogenic material is a physical mixture of two black fluoran colour formers in a heat sensitive recording system. There is, however, no mention in U.S. Pat. No. 4,226,912 of solid solutions of colour formers.

The properties which are most desirable in a colour forming material, in addition to the effective development of colour are: light fastness of the developed colour, heat fastness of the developed colour and moisture resistance. Typically, colour development in heat sensitive and electroheat sensitive recording materials has been provided by the action of a single colour former. However, the use of more than one colour former allows greater control over the shade produced and shows improved image resistance. Thus it would be desirable to develop a colour forming system comprising more than one colour forming material which demonstrated good light heat and moisture resistance.

OBJECTS OF THE INVENTION

An object of the present invention is to overcome the undesirable properties of single colour former compounds and mixtures of colour former compounds as the colour forming agent of the recording materials. Thus the present invention provides novel monophase solid solutions comprising a plurality of colour former compounds, having excellent properties for use in the pressure sensitive and heat sensitive recording material, particularly in the heat sensitive recording materials. It is a further object of this invention to provide processes for the manufacture of the novel monophase solid solutions.

DETAILED DESCRIPTION OF THE INVENTION

The monophase solid solutions of the invention are composed of a plurality of colour former compounds. The colour former compounds of the invention may be any known colour forming compounds such as fluoran type, phthalide type, phenoxazine type, phenothiazine type, rhodamine lactam type, leuco-auramine type, triphenylmethane type, spiropyran type, benzoxazine type, quinazoline type and the like. Amongst these, fluoran and phthalide type are preferable due to the ease of formation of solid solutions and superior properties in application.

As hereinbefore detailed the present invention relates to novel monophase solid solutions, processes for their manufacture and their uses in pressure sensitive and heat sensitive recording systems.

In the literature, the definitions by the various authors, such as, G. H. Van't Hoff, A. I. Kitaigorodsky and A. Whitacker for solid solutions and mixed crystals are often contradictory, (cf, e.g. 'Analytical Chemistry of Synthetic Dyes', Chapter 10/page 269, Editor K. Venkataraman, J. Wiley, New York, 1977).

The term 'monophase solid solution' or 'multiphase solid solution' or mixed crystal', as defined herein, therefore, should be taken from the following definitions, which have been adapted to the current improved state of knowledge of such systems:

A monophase (or single-phase or guest-host) solid solution possesses a crystal lattice which is identical with the crystal lattice of one of its components. One component is embedded as the 'guest' in the crystal lattice of the other component, which acts as the 'host'. The X-ray diffraction pattern of such a monophase solid solution is substantially identical to that of one of the components, called the 'host'. Within certain limits, different proportions of the components produce almost identical results.

A multiphase solid solution possesses no precise, uniform crystal lattice. It differs from a physical mixture of its components in that the crystal lattice of at least one of its components is partially or competely altered. In comparison to a physical mixture of the components, which gives an X-ray diffraction diagram that is additive of the diagrams seen for the individual components. The signals in the X-ray diffraction diagram of a multiphase solid solution are broadened, shifted or altered in intensity. In general, different proportions of the components produce different results.

A mixed crystal (or solid compound type) solid solution possesses a precise composition and a uniform crystal lattice, which is different from the crystal lattices of all its components. If different proportions of the components lead, within certain limits, to the same result, then a solid solution is present in which the mixed crystal acts as a host.

For the avoidance of doubt it may also be pointed out that, inter alia, there may also be amorphous structures and mixed aggregates consisting of different particles of different physical type, such as, for example, an aggregate of different components each in pure crystal modification. Such amorphous structures and mixed aggregates cannot be equated with either solid solutions or mixed crystals, and possess different fundamental properties.

As hereinbefore detailed, the novel monophase solid solutions comprise a plurality of colour compounds. Suitable colour forming materials which may be included in the solid solutions according to the present invention, include but are not limited to; 3-dibutylamino-7-dibenzylaminofluoran, 3-diethylamino-6-methylfluoran, 3-dimethylamino-6-methyl-7-anilinofluoran, 3-diethylamino-6-methyl-7-anilinofluoran, 3-diethylamino-6-methyl-7-(2,4-dimethylanilino)fluoran, 3-diethylamino-6-methyl-7-chlorofluoran, 3-diethylamino-6-methyl-7-(3-trifluoromethylanilino)fluoran, 3-diethylamino-6-methyl-7-(2-chloroanilino)fluoran, 3-diethylamino-6-methyl-7-(4-chloroanilino)fluoran, 3-diethylamino-6-methyl-7-(2-fluoroanilino)fluoran, 3-diethylamino-6-methyl-7-(4n-octylanilino)fluoran, 3-diethylamino7-(4-n-octylanilino) fluoran, 3-diethylamino-7-(4-n-octylamino)fluoran, 3-diethylamino-6-methyl-7-(dibenzylamino)fluoran, 3-diethylamino-7-(dibenzylamino)fluoran, 3-diethylamino-6-chloro-7-methylfluoran, 3-diethylamino-7-t-butylfluoran, 3-diethylamino-7-carboxyethylfluoran, 3-diethylamino-6-chloro-7-anilinofluoran, 3-diethylamino-6-methyl-7-(3-methylanilino)fluoran, 3-diethylamino-6-methyl-7-(4-methylanilino)fluoran, 3-diethylamino-6-ethoxyethyl-7-anilinofluoran, 3-diethylamino-7-methylfluoran, 3-diethylamino-7-chlorofluoran, 3-diethylamino-7-(3-trifluoromethylanilino)fluoran, 3-diethylamino-7-(2-chloroanilino)fluoran, 3-diethylamino-7-(2-fluoroanilino) fluoran, 3-diethylamino-benzo[a]fluoran, 3-diethylamino-benzo[c]fluoran, 3-dibutylamino-6-methyl fluoran, 3-dibutylamino-6-methyl-7-anilinofluoran, 3-dibutylamino-6-methyl-7-(2,4-dimethylanilino)fluoran, 3-dibutylamino-6-methyl-7-(2-chloroanilino)fluoran, 3-dibutylamino-6-methyl-7-(4-chloroanilino)fluoran, 3-dibutylamino-6-methyl-7-(2-fluoroanilino)fluoran, 3-dibutylamino-6-methyl-7-(3-trifluoromethylanilino)fluoran, 3-dibutylamino-6ethoxyethyl-7-anilinofluoran, 3-dibutylamino-6-chloro-anilinofluoran, 3-dibutylamino-6-methyl-7-(4-methylanilino)fluoran, 3-dibutylamino-7-(2chloroanilino)fluoran, 3-dibutylamino-7-(2-fluoroanilino) fluoran, 3-dipentylamino-6-methyl-7-anilinofluoran, 3-dipentylamino-6-methyl-7-(4-2-chloroanilino)fluoran, 3-dipentylamino-7-(3-trifluoromethylanilino)fluoran, 3-dipentylamino-6-chloro-7-anilinofluoran, 3-dipentylamino-7-(4-chloroanilino)fluoran, 3-pyrrolidino-6-methyl-7-anilinofluoran, 3-piperidino-6-methyl-7-anilinofluoran, 3-(N-methyl-N-propylamino)-6-methyl-7-anilinofluoran, 3-(N-methyl-N-cyclohexylamino)-6-methyl-7-anilinofluoran, 3-(N-ethyl-N-cyclohexylamino)-6-methyl-7-anilinofluoran, 3-(N-ethyl-p-toluidino)-6-methyl-7-anilinofluoran, 3-(N-ethyl-N-isoamylamino)-6-methyl-7-anilinofluoran, 3-(N-ethyl-N-isoamylamino)-6-chloro-7-anilinofluoran, 3-(N-ethyl-N-tetrahydrofurfurylamino)-6-methyl-7-anilinofluoran, 3-(N-ethyl-N-isobutylamino)-6-methyl-7-anilinofluoran, 3-(N-butyl-N-isoamylamino)-6-methyl-7-anilinofluoran, 3-(N-isopropyl-N-3-pentylamino)-6-methyl-7-anilinofluoran, 3-(N-ethyl-N-ethoxypropylamino)-6-methyl-7-anilinofluoran, 3-cyclohexylamino-6-chlorofluoran, 2-methyl-6-p-(p-dimethylaminophenyl)aminoanilinofluoran, 2-methoxy-6-p-(p-dimethylaminophenyl)aminoanilinofluoran, 2-chloro-3-methyl-6-p-(p-phenylaminophenyl)aminoanilinofluoran, 2-diethylamino-6-p-(p-dimethylaminophenylaminoanilinofluoran, 2-phenyl-6-methyl-6-p-(p-phenylaminophenyl)aminoanilinofluoran, 2-benzyl-6-p-(p-phenylaminophenyl)aminoanilinofluoran, 3-methyl-6-p-(p-dimethylaminophenyl) aminoanilinofluoran, 3-diethylamino-6-p-(p-diethylaminophenyl)aminoanilinofluoran, 3-diethylamino-6-p-(p-dibutylaminophenyl)aminoanilinofluoran, 2,4-dimethyl-6-[(4-dimethylamino)anilino]fluoran, 3,6,6'-tris (dimethylamino)spiro[fluorene-9,3'-phthalide], 3,6,6'-tris (diethylamino)spiro[fluorene-9,3'-phthalide], 3,3-bis(p-dimethylaminophenyl)-6-dimethylaminophthalide, 3,3-bis (p-dimethylaminophenyl)phthalide, 3,3-bis-[2-(p-dimethylaminophenyl)-2-(p-methoxyphenyl)ethenyl-4,5,6,7-tetrabromophthalide, 3,3-bis-[2-(p-dimethylaminophenyl)-2-(p-methoxyphenyl)ethenyl-4,5,6,7-tetrachlorophthalide, 3,3-bis[1,1-bis(4-pyrrolidinophenyl) ethylene-2-yl]-4,5,6,7-tetrabromophthalide, 3,3-bis-[1-(4-methoxyphenyl)-1-(4-pyrridinophenyl)ethylene-2-yl]-4,5,6,7-tetrachlorophthalide, 3-(4-diethylamino-2-ethoxyphenyl)-3-(1-ethyl-2-methylindole-3-yl)-4-azaphthalide, 3-(4-diethylamino-2-ethoxyphenyl)-3-(1-octyl-2-methylindole-3-yl)-4-azaphthalide, 3-(4-cyclohexylethylamino-2-methoxyphenyl)-3-(1-ethyl-2-methylindole-3-yl)-4-azaphthalide, 3,3-bis(1-ethyl-2-methylindole-3-yl) phthalide, 3,3-bis(1-octyl-2-methylindole-3-yl)phthalide, mixture of 2-phenyl-4-(4-diethylaminophenyl)-4-(4-methoxyphenyl)-6-methyl-7-dimethylamino-3,1-benzoxazine and 2-phenyl-4-(4-diethylaminophenyl)-4-(4-methoxyphenyl)-8-methyl-7-dimethylamino-3,1-benzoxazine, 4,4'-[1-methylethylidene)bis(4,1-phenyleneoxy-4,2-quinazolinediyl)]bis[N,N-diethylbenzenamine], bis(N-methyldiphenylamine)-4-yl-(N-butylcarbazole)-3-yl-methane.

Especially preferred herein are monophase solid solutions containing, as one of the components, a fluoran compound such as 3-dibutylamino-7-dibenzylaminofluoran, 3-diethylamino-6-methylfluoran, 3-dimethylamino-6-methyl-7-anilinofluoran, 3-diethylamino-6-methyl-7-anilinofluoran, 3-diethylamino-6-methyl-7-(2,4-dimethylanilino)fluoran, 3-diethylamino-6-methyl-7-chlorofluoran, 3-diethylamino-6-methyl-7-(3-trifluoromethylanilino)fluoran, 3-diethylamino-6-methyl-7-(2-chloroanilino)fluoran, 3-diethylamino-6-methyl-7-(4-chloroanilino)fluoran, 3-diethylamino-6-methyl-7-(2-fluoroanilino)fluoran, 3-diethylamino-6-methyl-7-(4-n-octylanilino)fluoran, 3-diethylamino-7-(4-n-octylanilino) fluoran, 3-diethylamino-7-(n-octylamino)fluoran, 3-diethylamino-6-methyl-7-(dibenzylamino)fluoran, 3-diethylamino-7-(dibenzylamino)fluoran, 3-diethylamino-6-chloro-7-methylfluoran, 3-diethylamino-7-t-butylfluoran, 3-diethylamino-7-carboxyethylfluoran, 3-diethylamino-6-chloro-7-anilinofluoran, 3-diethylamino-6-methyl-7-(3-methylanilino)fluoran, 3-diethylamino-6-methyl-7-(4-methylanilino)fluoran, 3-diethylamino-6-ethoxyethyl-7-anilinofluoran, 3-diethylamino-7-methylfluoran, 3-diethylamino-7-chlorofluoran, 3-diethylamino-7-(3-trifluoromethylanilino)fluoran, 3-diethylamino-7-(2-chloroanilino)fluoran, 3-diethylamino-7-(2-fluoroanilino) fluoran, 3-diethylamino-benzo[a]fluoran, 3-diethylamino-benzo[c]fluoran, 3-dibutylamino-6-methyl fluoran, 3-dibutylamino-6-methyl-7-anilinofluoran, 3-dibutylamino-6-methyl-7-(2,4-dimethylanilino)fluoran, 3-dibutylamino-6-methyl-7-(2-chloroanilino)fluoran, 3-dibutylamino-6-methyl-7-(4-chloroanilino)fluoran, 3-dibutylamino-6-methyl-7-(2-fluoroanilino)fluoran, 3-dibutylamino-6-methyl-7-(3-trifluoromethylanilino)fluoran, 3-dibutylamino-6-ethoxyethyl-7-anilinofluoran, 3-dibutylamino-6-chloro-anilinofluoran, 3-dibutylamino-6-methyl-7-(4-methylanilino)fluoran, 3-dibutylamino-7-(2-chloroanilino)fluoran, 3-dibutylamino-7-(2-fluoroanilino) fluoran, 3-dipentylamino-6-methyl-7-anilinofluoran, 3-dipentylamino-6-methyl-7-(4-2-chloroanilino)fluoran, 3-dipentylamino-7-(3-trifluoromethylanilino)fluoran, 3-dipentylamino-6-chloro-7-anilinofluoran, 3-dipentylamino-7-(4-chloroanilino)fluoran, 3-pyrrolidino-6-methyl-7-anilinofluoran, 3-piperidino-6-methyl-7-anilinofluoran, 3-(N-methyl-N-propylamino)-6-methyl-7-anilinofluoran, 3-(N-methyl-N-cyclohexylamino)-6-methyl-7-anilinofluoran, 3-(N-ethyl-N-cyclohexylamino)-6-methyl-7-anilinofluoran, 3-(N-ethyl-p-toluidino)-6-methyl-7-anilinofluoran, 3-(N-ethyl-N-isoamylamino)-6-methyl-7-anilinofluoran, 3-(Nethyl-N-isoamylamino)-6-chloro-7-anilinofluoran, 3-(N-ethyl-N-tetrahydrofurfurylamino)-6-methyl-7-anilinofluoran, 3-(N-ethyl-N-isobutylamino)-6-methyl-7-anilinofluoran, 3-(N-butyl-N-isoamylamino)-6-methyl-7-anilinofluoran, 3-(N-isopropyl-N-3-pentylamino)-6-methyl-7-anilinofluoran, 3-(N-ethyl-N-ethoxypropylamino)-6-methyl-7-anilinofluoran, 3-cyclohexylamino-6-chlorofluoran, 2-methyl-6-p-(p-dimethylaminophenyl)aminoanilinofluoran, 2-methoxy-6-p-(p-dimethylaminophenyl)aminoanilinofluoran, 2-chloro-3-methyl-6-p-(p-phenylaminophenyl)aminoanilinofluoran, 2-diethylamino-6-p-(p-dimethylaminophenyl)aminoanilinofluoran, 2-phenyl-6-methyl-6-p-(p-phenylaminophenyl)aminoanilinofluoran, 2-benzyl-6-p-(p-phenylaminophenyl)aminoanilinofluoran, 3-methyl-6-p-(p-dimethylaminophenyl)aminoanilinofluoran, 3-diethylamino-6-p-(p-diethylaminophenyl)aminoanilinofluoran, 3-diethylamino-6-p-(p-dibutylaminophenyl)aminoanilinofluoran, 2,4-dimethyl-6-[(4-dimethylamino)anilino]fluoran.

Highly preferred monophase solid solutions according to the present invention are composed of at least two fluoran compounds of the general formula (I).

Formula I

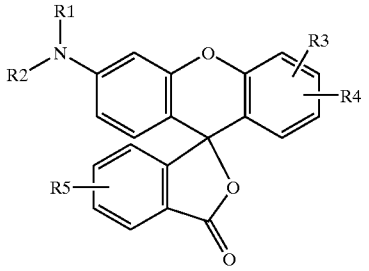

Wherein, R1 and R2 independently represent hydrogen; an alkyl of 1–18 carbon; a secondary alkyl with respect to the carbon atom bonded to the nitrogen atom of 3–13 carbon atoms; a cycloalkyl of 4–8 carbon atoms or a phenyl, both of which may be substituted by at least one substituent selected from the group consisting of halogen atoms and alkyls having 1–4 carbon atoms; an aralkyl of 7–10 carbon atoms. Alternatively, R1 and R2, together with the adjacent nitrogen atom may form a heterocyclic ring. R3 is hydrogen; an alkyl of 1–4 carbon atoms; an alkoxy of 1–4 carbon atoms; a phenyl; a substituted phenyl or a halogen. R4 is an alkyl group of 1–18 carbon atoms; a carboxyalkyl of 1–18 carbon atoms; a carboxycycloalkyl of 4–8 carbon atoms; a alkylamino of 1–18 carbon atoms; a cycloalkylamino of 4–8 carbon atoms; a dialkylamino or dicycloalkylamino as previously defined; an arylamino; a substituted arylamino; an aralkylamino of 7–10 carbon atoms; a diaralkylamino as previously defined. R5 is an alkyl of 1–18 carbon atoms; a carboxy alkyl of 1–18 carbon atoms or a halogen.

The ratio of the components being in the range 0.1–99% by mole, especially 0.1–30%.

Highly preferred are the following exemplary monophase solid solutions comprising two components A and B in the stated ratios: 3-dibutylamino-6-methyl-7-anilinofluoran (95%), 3-dibutylamino-7-dibenzylaminofluoran (5%); 3-dibutylamino-6-methyl-7-anilinofluoran (99.9%), 3-diethylamino-6-methyl-7-anilinofluoran (0.1%); 3-dibutylamino-6-methyl-7-anilinofluoran (99%), 3-diethylamino-6-methyl-7-anilinofluoran (1%); 3-dibutylamino-6-methyl-7-anilinofluoran (95%), 3-diethylamino-6-methyl-7-anilinofluoran (5%); 3-dibutylamino-6-methyl-7-anilinofluoran (90%), 3-diethylamino-6-methyl-7-anilinofluoran (10%); 3-dibutylamino-6-methyl-7-anilinofluoran (85%), 3-diethylamino-6-methyl-7-anilinofluoran (15%); 3-dibutylamino-6-methyl-7-anilinofluoran (80%), 3-diethylamino-6-methyl-7-anilinofluoran (20%); 3-dibutylamino-6-methyl-7-anilinofluoran (95%), 3-N-isoamyl-N-ethylamino-6-methyl-7-anilinofluoran (5%); 3-dibutylamino-6-methyl-7-anilinofluoran (90%), 3-N-isoamyl-N-ethylamino-6-methyl-7-anilinofluoran (10%);3-dibutylamino-6-methyl-7-anilinofluoran (80%), 3-N-isoamyl-N-ethylamino-6-methyl-7-anilinofluoran (20%);3-dibutylamino-6-methyl-7-anilinofluoran (90%), 3-N-cyclohexyl-N-methylamino-6-methyl-7-anilinofluoran (10%);3-diethylamino-6-methyl-7-anilinofluoran (90%), 3-N-isoamyl-N-ethylamino-6-methyl-7-anilinofluoran (10%);3-diethylamino-6-methyl-7-anilinofluoran (80%), 3-N-isoamyl-N-ethylamino-6-methyl-7-anilinofluoran (20%);3-diethylamino-6-methyl-7-anilinofluoran (20%), 3-N-isoamyl-N-ethylamino-6-methyl-7-anilinofluoran (80%);3-diethylamino-6-methyl-7-anilinofluoran (10%), 3-N-isoamyl-N-ethylamino-6-methyl-7-anilinofluoran (90%);3-diethylamino-6-methyl-7-anilinofluoran (90%), 3-N-propyl-N-methylamino-6-methyl-7-anilinofluoran (10%);3-diethylamino-6-methyl-7-anilinofluoran (80%), 3-N-propyl-N-methylamino-6-methyl-7-anilinofluoran (20%);3-diethylamino-6-methyl-7-anilinofluoran (20%), 3-N-propyl-N-methylamino-6-methyl-7-anilinofluoran (80%);3-diethylamino-6-methyl-7-anilinofluoran (10%), 3-N-propyl-N-methylamino-6-methyl-7-anilinofluoran (90%);3-diethylamino-6-methyl-7-anilinofluoran (10%), 3-diethylamino-6-methyl-7-(3-tolyl)aminofluoran (90%);3-diethylamino-6-methyl-7-anilinofluoran (20%), 3-diethylamino-6-methyl-7-(3-tolyl)aminofluoran (80%);3-dibutylamino-6-methyl-7-anilinofluoran (90%), 3,3-bis(1-octyl-2-methylindol-3-yl)phthalide (10%); 3-dibutylamino-6-methyl-7-anilinofluoran (80%), 3,3-bis(1-octyl-2-methylindol-3-yl)phthalide(20%);3-dibutylamino-6-methyl-7-anilinofluoran (90%),mixture of 2-phenyl-4-(4-diethylaminophenyl)-4-(4-methoxyphenyl)-6-methyl-7-dimethylamino-3,1-benzoxazine and 2-phenyl-4-(4-diethylaminophenyl)-4-(4-methoxyphenyl)-8-methyl-7-dimethylamino-3,1-benzoxazine(10%);3-dibutylamino-6-methyl-7-anilinofluoran (80%),mixture of 2-phenyl-4-(4-diethylaminophenyl)-4-(4-methoxyphenyl)-6-methyl-7-dimethylamino-3,1-benzoxazine and 2-phenyl-4-(4-diethylaminophenyl)-4-(4-methoxyphenyl)-8-methyl-7-dimethylamino-3,1-benzoxazine(20%); 3-dibutylamino-6-methyl-7-anilinofluoran (90%), 4,4'-[1-methylethylidene)bis(4,1-phenyleneoxy-4,2-quinazoinediyl)]bis[N,N-diethylbenzenamine](10%);3-dibutylamino-6-methyl-7-anilinofluoran (80%), 4,4'-[1-methylethylidene)bis(4,1-phenyleneoxy-4,2-quinazolinediyl)]bis[N,N-diethylbenzenenamine](20%).

The novel monophase solid solutions according to the present invention can be prepared by a variety of methods. One such method is the recrystallisation method wherein a physical mixture of the desired components is dissolved, with or without heating, in a suitable solvent or solvent mixture. Suitable solvents include but are not limited to toluene, benzene, xylene, dichlorobenzene, chlorobenzene, 1,2-dichloroethane, methanol, ethanol, iso-propanol, n-butanol, acetonitrile, dimethylformamide or mixtures of these solvents with each other and with water. The monophase solid solution is then isolated by crystallization from the solvent or solvent mixture. This can be brought about by cooling, standing, addition of a further solvent to promote crystallisation or concentration by standard means such as distillation, steam distillation and vacuum distillation. When the monophase solid solution is isolated by concentration it may be advantageous to do so in the presence of a small amount of base, as decribed herein, to improve the visual aspect of the isolated product Alternatively, monophase solid solutions of the invention can be prepared from mixtures of the appropriate starting materials. Such a methodology is the subject of a co-pending patent and can also be used to produce amorphous mixtures, multiphase solid solutions and mixed crystals. The technique can be used to produce mixtures of two or more fluorans or phthalides. For example, mixtures of two fluorans are produced by replacing a single starting material with two analogous materials to the same total molar concentration in the reaction. In the case of fluorans, these starting materials are derivatives of amino phenols, phthalic anhydrides, keto acids and diphenylamines. The methodology is exemplified in the following syntheses of monophase solid solutions.

The first novel method of preparation uses the reaction of an appropriate mixture of keto acids of formula (II) and compounds of formula (III) to give the desired monophase solid solution. R1–R5 have the meanings given previously and R6 is hydrogen or alkyl of 1–4 carbon atoms.

Formula II

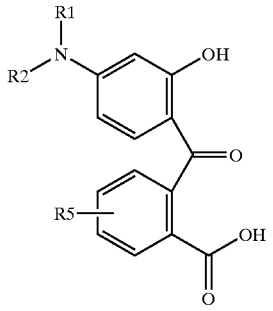

Formula III

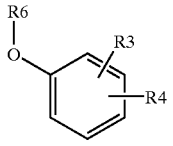

For instance, a two component monophase solution consisting of two compounds of general formula (I) may be prepared by reaction of;

i. Two different keto acids of general formula (II) with a single compound of general formula (III).

ii. Two different compounds of general formula (III) with a single keto acid of formula (II).

Compounds of general formula II are exemplified by, but not limited to; 2-hydroxy-4-N,N-di-methyl amino-2'-carboxybenzophenone, 2-hydroxy-4-N,N-di-ethyl amino-2'-carboxybenzophenone, 2-hydroxy-4-N,N-di-n-propyl amino-2'-carboxybenzophenone, 2-hydroxy-4-N,N-di-n-butyl amino-2'-carboxybenzophenone, 2-hydroxy-4-N,N-di-n-pentyl amino-2'-carboxybenzophenone, 2-hydroxy-4-N,N-di-n-hexyl amino-2'-carboxybenzophenone, 2-hydroxy-4-N,N-diisopropyl amino-2'-carboxybenzophenone, 2-hydroxy-4-N,N-disecbutyl amino-2'-carboxybenzophenone, 2-hydroxy-4-N,N-diisobutyl amino-2'-carboxybenzophenone, 2-hydroxy-4-N,N-diisoamyl amino-2'-carboxybenzophenone, 2-hydroxy-4-N-methyl-N-cyclohexyl amino-2'-carboxybenzophenone, 2-hydroxy-4-N-methyl-N-phenyl amino-2'-carboxybenzophenone, 2-hydroxy-4-N-methyl-N-(2-methylphenyl)amino-2'-carboxybenzophenone, 2-hydroxy-4-N-methyl-N-(3-methylphenyl)amino-2'-carboxybenzophenone, 2-hydroxy-4-N-methyl-N-(4-methylphenyl)amino-2'-carboxybenzophenone, 2-hydroxy-4-N-methyl-N-propyl amino-2'-carboxybenzophenone, 2-hydroxy-4-N-methyl-N-isopropyl amino-2'-carboxybenzophenone, 2-hydroxy-4-N-methy-N-butyl amino-2'-carboxybenzophenone, 2-hydroxy-4-N-methyl-N-isobutyl amino-2'-carboxybenzophenone, 2-hydroxy-4-N-methyl-N-secbutyl amino-2'-carboxybenzophenone, 2-hydroxy-4-N-methyl-N-pentyl amino-2'-carboxybenzophenone, 2-hydroxy-4-N-methyl-N-1-methylbutyl amino-2'-carboxybenzophenone, 2-hydroxy-4-N-methyl-N-isoamyl amino-2'-carboxybenzophenone, 2-hydroxy-4-N-methyl-N-1-methylpentyl amino-2'-carboxybenzophenone, 2-hydroxy-4-N-methyl-N-hexyl amino-2'-carboxybenzophenone, 2-hydroxy-4-N-methyl-N-tetrahydrofurylmethyl amino-2'-carboxybenzophenone, 2-hydroxy-4-N-methyl-N-ethoxypropyl amino-2'-carboxybenzophenone, 2-hydroxy-4-N-methyl-N-cyclohexylmethyl amino-2'-carboxybenzophenone, 2-hydroxy-4-N-methyl-N-phenethyl amino-2'-carboxybenzophenone, 2-hydroxy-4-N-ethyl-N-cyclohexyl amino-2'-carboxybenzophenone, 2-hydroxy-4-N-ethyl-N-phenyl amino-2'-carboxybenzophenone, 2-hydroxy-4-N-ethyl-N-(2-methylphenyl)amino-2'-carboxybenzophenone, 2-hydroxy-4-N-ethyl-N-(3-methylphenyl)amino-2'-carboxybenzophenone, 2-hydroxy-4-N-ethyl-N-(4-methylphenyl)amino-2'-carboxybenzophenone, 2-hydroxy-4-N-ethyl-N-propyl amino-2'-carboxybenzophenone, 2-hydroxy-4-N-ethyl-N-isopropyl amino-2'-carboxybenzophenone, 2-hydroxy-4-N-ethyl-N-butyl amino-2'-carboxybenzophenone, 2-hydroxy-4-N-ethyl-N-isobutyl amino-2'-carboxybenzophenone, 2-hydroxy-4-N-ethyl-N-secbutyl amino-2'-carboxybenzophenone, 2-hydroxy-4-N-ethyl-N-pentyl amino-2'-carboxybenzophenone, 2-hydroxy-4-N-ethyl-N-1-methylbutyl amino-2'-carboxybenzophenone, 2-hydroxy-4-N-ethyl-N-isoamyl amino-2'-carboxybenzophenone, 2-hydroxy-4-N-ethyl-N-1-methylpentyl amino-2'-carboxybenzophenone, 2-hydroxy-4-N-ethyl-N-hexyl amino-2'-carboxybenzophenone, 2-hydroxy-4-N-ethyl-N-tetrahydrofurylmethyl amino-2'-carboxybenzophenone, 2-hydroxy-4-N-ethyl-N-ethoxypropyl amino-2'-carboxybenzophenone, 2-hydroxy-4-N-ethyl-N-cyclohexylmethyl amino-2'-carboxybenzophenone, 2-hydroxy-4-N-ethyl-N-phenethyl amino-2'-carboxybenzophenone, 2-hydroxy-4-N-propyl-N-cyclohexyl amino-2'-carboxybenzophenone, 2-hydroxy-4-N-propyl-N-phenyl amino-2'-carboxybenzophenone, 2-hydroxy-4-N-propyl-N-(2-methylphenyl)amino-2'-carboxybenzophenone, 2-hydroxy-4-N-propyl-N-(3-methylphenyl)amino-2'-carboxybenzophenone, 2-hydroxy-4-N-propyl-N-(4-methylphenyl)amino-2'-carboxybenzophenone, 2-hydroxy-4-N-propyl-N-isopropyl amino-2'-carboxybenzophenone, 2-hydroxy-4-N-propyl-N-butyl amino-2'-carboxybenzophenone, 2-hydroxy-4-N-propyl-N-isobutyl amino-2'-carboxybenzophenone, 2-hydroxy-4-N-propyl-N-secbutyl amino-2'-carboxybenzophenone, 2-hydroxy-4-N-propyl-N-pentyl amino-2'-carboxybenzophenone, 2-hydroxy-4-N-propyl-N-1-methylbutyl amino-2'-carboxybenzophenone, 2-hydroxy-4-N-propyl-N-isoamyl amino-2'-carboxybenzophenone, 2-hydroxy-4-N-propyl-N-1-methylpentyl amino-2'-carboxybenzophenone, 2-hydroxy-4-N-propyl-N-hexyl amino-2'-carboxybenzophenone, 2-hydroxy-4-N-propyl-N-tetrahydrofurylmethyl amino-2'-carboxybenzophenone, 2-hydroxy-4-N-propyl-N-ethoxypropyl amino-2'- carboxybenzophenone, 2-hydroxy-4-N-propyl-N-cyclohexylmethyl amino-2'-carboxybenzophenone, 2-hydroxy-4-N-propyl-N-phenethyl amino-2'-carboxybenzophenone, 2-hydroxy-4-N-butyl-N-cyclohexyl amino-2'-carboxybenzophenone, 2-hydroxy-4-N-butyl-N-phenyl amino-2'-carboxybenzophenone, 2-hydroxy-4-N-butyl-N-(2-methylphenyl)amino-2'-carboxybenzophenone, 2-hydroxy-4-N-butyl-N-(3-methylphenyl)amino-2'-carboxybenzophenone, 2-hydroxy-4-N-butyl-N-(4-methylphenyl)amino-2'-carboxybenzophenone, 2-hydroxy-4-N-butyl-N-propyl amino-2'-carboxybenzophenone, 2-hydroxy-4-N-butyl-N-isopropyl amino-2'-carboxybenzophenone, 2-hydroxy-4-N-butyl-N-isobutyl amino-2'-carboxybenzophenone, 2-hydroxy-4-N-butyl-N-secbutyl amino-2'-carboxybenzophenone, 2-hydroxy-4-N-butyl-N-pentyl amino-2'-carboxybenzophenone, 2-hydroxy-4-N-butyl-N-1-methylbutyl amino-2'-carboxybenzophenone, 2-hydroxy-4-N-butyl-N-isoamyl amino-2'-carboxybenzophenone, 2-hydroxy-4-N-butyl-N-1-methylpentyl amino-2'-carboxybenzophenone, 2-hydroxy-4-N-butyl-N-hexyl amino-2'-carboxybenzophenone, 2-hydroxy-4-N-butyl-N-tetrahydrofurylmethyl amino-2'-carboxybenzophenone, 2-hydroxy-4-N-butyl-N-ethoxypropyl amino-2'-carboxybenzophenone, 2-hydroxy-4-N-butyl-N-cyclohexylmethyl amino-2'-carboxybenzophenone, 2-hydroxy-4-N-butyl-N-phenethyl amino-2'-carboxybenzophenone, 2-hydroxy-4-N-phenyl amino-2'-carboxybenzophenone, 2-hydroxy-4-N-(2-methylphenyl)amino-2'-carboxybenzophenone, 2-hydroxy-4-N-(3-methylphenyl)amino-2'-carboxybenzophenone, 2-hydroxy-4-N-(4-methylphenyl)amino-2'-carboxybenzophenone, 2-hydroxy-4-N-cyclohexyl amino-2'-carboxybenzophenone, 2-hydroxy-4-N-pyrrolidinyl-2'-carboxybenzophenone, 2-hydroxy-4-N-(2-methylpyrrolidinyl)-2'-carboxybenzophenone, 2-hydroxy-4-N-(3-methylpyrrolidinyl)-2'-carboxybenzophenone, 2-hydroxy-4-N-morpholinyl-2'-carboxybenzophenone, 2-hydroxy-4N-piperidinyl-2'-carboxybenzophenone, 2-hydroxy-4-N-(2-methylpiperidinyl)-2'-carboxybenzophenone, 2-hydroxy-4-N-(3-methylpiperidinyl)-2'-carboxybenzophenone, 2-hydroxy-4-N-(4-methylpiperidinyl)-2'-carboxybenzophenone, 2-hydroxy-4-N-(4-Dimethylaminophenyl)-2'-carboxybenzophenone, 2-hydroxy-3,5-dimethyl-2'-carboxybenzophenone.

Compounds of formula III are exemplified by, but not limited to; 4-N,N-dibenzylaminophenol, 4-N,N-dibenzylaminoanisidine, 3-methoxy toluene, 3-methylphenol, 4-methoxy toluene, 4-methylphenol, 2,4-dimethylanisole, 2,4-dimethylphenol, 4-methoxy-2-methyl diphenylamine, 4-hydroxy-2-methyl diphenylamine, 4-methoxy-2,2',4'-trimethyl diphenylamine, 4-hydroxy-2,2',4'-trimethyl diphenylamine, 2-chloro-5-methoxy toluene, 2-chloro-5-hydroxy toluene, 4-methoxy-2-methyl-3'-trifluoromethyl diphenylamine, 4-hydroxy-2-methyl-3'-trifluoromethyl diphenylamine, 4-methoxy-2-methyl-2'-chloro diphenylamine, 4-hydroxy-2-methyl-2'-chloro diphenylamine, 4-methoxy-2-methyl4'-chloro diphenylamine, 4-methoxy-2-methyl-2'-fluoro diphenylamine, 4-hydroxy-2-methyl-2'-fluoro diphenylamine, n-octyl-p-anisidine, N-n-octyl-p-aminophenol, 2-dibenzylamino-5-methoxy-toluene, 4-dibenzylamino-3-methylphenol, 4-methoxy-2-chloro diphenylamine, 4-hydroxy-2-chloro diphenylamine, 4-methoxy-2,3'-dimethyl diphenylamine, 4-hydroxy-2,3'-dimethyl diphenylamine, 4-methoxy-2,4'-dimethyl diphenylamine, 4-hydroxy-2,4'-dimethyl diphenylamine, 3-chloroanisole, 3-chlorophenol, 1-naphthol, 1-methoxy naphthalene, 2-naphthol, 2-methoxy naphthalene, 4-methoxy-2-ethoxyethyl diphenylamine, 4-hydroxy-2-ethoxyethyl diphenylamine, 4-t-butyl phenol, 4-t-butyl anisole, 4-hydroxybenzoic acid, 4-methoxy benzoic acid, 4-hydroxybenzoic acid ethyl ester, 4-methoxy benzoic acid ethyl ester, 3-(p-dimethylamino)anilinoanisole, 3-(p-dimethylamino)anilinophenol.

Thus the novel monophase solid solutions can be prepared by reaction between keto acid(s) of formula (II) and compound(s) of formula (III) in the presence of a dehydrating condensation agent, for example, concentrated sulphunc acid, oleum-concentrated sulphuric acid mixtures, polyphosphoric acid, phosphorous pentaoxide or anhydrous aluminium chloride, and mixtures thereof, preferably concentrated sulphuric acid or oleum-concentrated sulphuric acid mixtures, and thereafter bringing the reaction mixture to an alkaline pH in the presence or absence of organic solvent. The solvent, if used, is not specifically limited provided that it is insoluble or only slightly soluble in water. Thus, the solvent may be exemplified by aromatic hydrocarbons such as benzene, toluene, xylenes or trimethyl benzenes, halogenated aromatic hydrocarbons such as chlorobenzene, dichlorobenzenes, trichlorobenzenes or bromonaphthalenes, halogenated aliphatic hydrocarbons such as dichloroethane, trichloroethane or tetrachloroethane, aliphatic hydrocarbons such as hexane, heptane, octane or n-decane and alicyclic hydrocarbons such as cyclohexane or methylcyclohexane.

In addition to the above there may also be used alcohols such as amyl alcohol, 2-ethylhexanol or octyl alcohol, ethers such as isopropyl ether, esters such as ethyl acetate or ketones such as cyclohexanone. The solvent may be used singly or as a mixture.

The condensation reaction is generally carried out at from 0 to about 100° C. preferably from about 10 to about 60° C. for several to 100 hours. When the reaction is carried out in concentrated sulphuric acid or oleum-concentrated sulphuric acid mixtures, the reaction temperature is preferably in the range from 0 to about 50° C. The reaction time depends upon the selected reaction temperature and hence the reaction is conducted for a sufficient time to permit the reaction to go to completion. Completion of reaction is determined using standard analytical techniques, including but not limited to, thin layer chromatography, gas chromatography and liquid chromatography.

After the dehydrating condensation reaction is completed the alkali treatment may be carried out by addition of the reaction mass to a stirred mixture of base, water and organic solvent. Suitable bases include, for example, potassium hydroxide, lithium hydroxide, sodium hydroxide, potassium carbonate, sodium carbonate, lithium carbonate, ammonia or organic bases such as triethylamine and mixtures thereof. The preferred bases for use in the process of the present invention are sodium hydroxide and potassium hydroxide. Suitable solvents include toluene, xylene, halogenated aromatic solvents such as chlorobenzene, esters, ethers, ketones, alcohols such as 2-ethylhexanol and mixtures thereof.

Additional base may be added as required to achieve an alkalinity within the pH range of 9–12. The treatment may be conducted in a temperature of from 0° C. to the boiling point of the solvent or solvent mixture in use, preferably 50–100° C. During this process, the monophase solid solution according to the present invention may be precipitated from the reaction media. The crystalline precipitate may then be isolated by filtration from the reaction liquors.

After isolation, the monophase solid solution may be washed as desired with water and/or an organic solvent. The solvent may be exemplified by aromatic hydrocarbons such as benzene, toluene, xylenes or trimethyl benzenes, halogenated aromatic hydrocarbons such as chlorobenzene, dichlorobenzenes, trichlorobenzenes or bromonaphthalenes, halogenated aliphatic hydrocarbons such as dichloroethane, trichloroethane or tetrachloroethane, aliphatic hydrocarbons such as hexane, heptane, octane or n-decane and alicyclic hydrocarbons such as cyclohexane or methylcyclohexane. In addition to the above there may also be used alcohols such as methanol, ethanol, isopropanol, butanol, amyl alcohol, 2-ethylhexanol or octyl alcohol, ethers such as isopropyl ether, or ketones such as cyclohexanone. The solvent may be used singly or as a mixture.

Alternatively, after the dehydrating condensation, the reaction mass may be quenched into a stirred water-solvent mixture at from 0° C. to the boiling point of the water-solvent mixture in use, preferably 50–100° C. The solvent used is not specifically limited provided that it is insoluble or only slightly soluble in water. Thus, the solvent may be exemplified by aromatic hydrocarbons such as benzene, toluene, xylenes or trimethyl benzenes, halogenated aromatic hydrocarbons such as chlorobenzene, dichlorobenzenes, trichlorobenzenes or bromonaphthalenes, halogenated aliphatic hydrocarbons such as dichloroethane, trichloroethane or tetrachloroethane, aliphatic hydrocarbons such as hexane, heptane, octane or n-decane and alicyclic hydrocarbons such as cyclohexane or methylcyclohexane. In addition to the above there may also be used alcohols such as amyl alcohol, 2-ethylhexanol or octyl alcohol, ethers such as isopropyl ether, or ketones such as cyclohexanone. The solvent may be used singly or as a mixture. Sufficient base, for example potassium hydroxide, lithium hydroxide, sodium hydroxide, potassium carbonate, sodium carbonate, lithium carbonate, ammonia or organic bases such as tnethylamine and mixtures thereof, is then added to provide an organic-aqueous phase separation. The aqueous layer may then be separated if desired. To the organic phase or biphasic mixture, containing the phthalide intermediate, is then added further base, as described hereinbefore, to pH>7. The reaction mass is stirred at from 0 to about 100° C., preferably 60–90° C., in order to complete cyclisation to the fluoran product. The reaction mass is then adjusted to 25° C. and the precipitated crystalline product may then be isolated by filtration as discussed hereinbefore. The reaction product is isolated by filtration from the reaction liquors as the crystal of the invention. After isolation, the crystal may be washed with water and/or an organic solvent as defined previously. In this manner is isolated the novel monophase solid solution of the invention.

This recrystallised crystalline product may then be dried by a usual method, such as at a raised temperature, below the melting point of the crystal of the invention, under vacuum, to obtain the novel monophase solid solutions of the present invention. The composition of the monophase solid solution obtained is dependant upon the relative amounts of starting materials used.

A third method of preparation is to prepare a mixed keto acid intermediate of general formula (II) from the reaction of aminophenols of general formula (IV) with phthalic anhydrides of general formula (V). Wherein R1,R2 and R5 are as hereinbefore detailed.

Formula IV

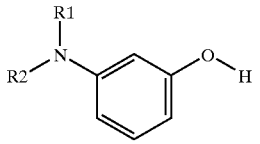

Formula V

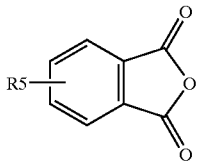

For instance, a mixed keto acid intermediate consisting of two compounds of general formula (II) may be prepared by reaction of;

i. Two different amino phenols of general formula (IV) with a single phthalic anhydride derivative of formula (V).

ii. Two different phthalic anhydride derivatives if formula (V) with a single amino phenol of general formula (IV).

Amino phenols of formula IV are exemplified by, but not limited to: N,N-dimethyl aminophenol, N,N-diethyl aminophenol, N,N-di-n-propyl aminophenol, N,N-di-n-butyl aminophenol, N,N-di-n-pentyl aminophenol, N,N-di-n-hexyl aminophenol, N,N-diisopropyl aminophenol, N,N-disecbutyl aminophenol, N,N-diisobutyl aminophenol, N,N-diisoamyl aminophenol, N-methyl-N-cyclohexyl aminophenol, N-methyl-N-phenyl aminophenol, N-methyl-N-(2-methylphenyl)aminophenol, N-methyl-N-(3-methylphenyl)aminophenol, N-methyl-N-(4-methylphenyl) aminophenol, N-methyl-N-propyl aminophenol. N-methyl-N-isopropyl aminophenol, N-methyl-N-butyl aminophenol, N-methyl-N-isobutyl aminophenol, N-methyl-N-secbutyl aminophenol, N-methyl-N-pentyl aminophenol, N-methyl-N-1-methylbutyl aminophenol, N-methyl-N-isoamyl phenol, N-methyl-N-1-methylpentyl aminophenol, N-methyl-N-hexyl aminophenol, N-methyl-N-tetrahydrofurylmethyl aminophenol, N-methyl-N-ethoxypropyl aminophenol, N-methyl-N-cyclohexylmethyl aminophenol, N-methyl-N-phenethyl aminophenol, N-ethyl-N-cyclohexyl aminophenol, N-ethyl-N-phenyl aminophenol, N-ethyl-N-(2-methylphenyl)aminophenol, N-ethyl-N-(3-methylphenyl)aminophenol, N-ethyl-N-(4-methylphenyl)aminophenol, N-ethyl-N-propyl aminophenol, N-ethyl-N-isopropyl aminophenol, N-ethyl-N-butyl aminophenol, N-ethyl-N-isobutyl aminophenol, N-ethyl-N-secbutyl aminophenol, N-ethyl-N-pentyl aminophenol, N-ethyl-N-1-methylbutyl aminophenol, N-ethyl-N-isoamyl phenol, N-ethyl-N-1-methylpentyl aminophenol, N-ethyl-N-hexyl aminophenol, N-ethyl-N-tetrahydrofurylmethyl aminophenol, N-ethyl-N-ethoxypropyl aminophenol, N-ethyl-N-cyclohexylmethyl aminophenol, N-ethyl-N-phenethyl aminophenol, N-propyl-N-cyclohexyl aminophenol, N-propyl-N-phenyl aminophenol, N-propyl-N-(2-methylphenyl)aminophenol, N-propyl-N-(3-methylphenyl)aminophenol, N-propyl-N-(2-methylphenyl)aminophenol, N-propyl-N-isopropyl aminophenol, N-propyl-N-butyl aminophenol, N-propyl-N-isobutyl aminophenol, N-propyl-N-secbutyl aminophenol, N-propyl-N-pentyl aminophenol, N-propyl-N-1-methylbutyl aminophenol, N-propyl-N-isoamyl phenol, N-propyl-N-1-methylpentyl aminophenol, N-propyl-N-hexyl aminophenol, N-propyl-N-tetrahydrofurylmethyl aminophenol, N-propyl-N-ethoxypropyl aminophenol, N-propyl-N-cyclohexylmethyl aminophenol, N-propyl-N-phenethyl aminophenol, N-butyl-N-cyclohexyl aminophenol, N-butyl-N-phenyl aminophenol, N-butyl-N-(2-methylphenyl)aminophenol, N-butyl-N-(3-methylphenyl)aminophenol, N-butyl-N-(4-methylphenyl) aminophenol, N-butyl-N-propyl aminophenol, N-butyl-N-isopropyl aminophenol, N-butyl-N-isobutyl aminophenol, N-butyl-N-secbutyl aminophenol, N-butyl-N-pentyl aminophenol, N-butyl-N-1-methylbutyl aminophenol, N-butyl-N-isoamyl phenol, N-butyl-N-1-methylpentyl aminophenol, N-butyl-N-hexyl aminophenol, N-butyl-N-tetrahydrofurylmethyl aminophenol, N-butyl-N-ethoxypropyl aminophenol, N-butyl-N-cyclohexylmethyl aminophenol, N-butyl-N-phenethyl aminophenol, N-phenyl aminophenol, N-2-methylphenyl aminophenol, N-3-methylphenyl aminophenol, N-4-methylphenyl aminophenol, N-cydcohexyl aminophenol, 3-N-pyrrolidinyl phenol, 3-N-(2-methylpyrrolidinyl)phenol, 3-N-(3-methylpyrrolidinyl)phenol,3-N-morpholinyl phenol, 3-N-piperidinyl phenol, 3-N-(2-methylpiperidinyl)phenol, 3-N-(3-methylpipendinyl)phenol, 3-N-(4-methylpiperidinyl) phenol.

Compounds of formula V are exemplified by, but not limited to; phthalic anhydride, terephthalic anhydride, 3-methylphthalic anhydride, 3-nitrophthalic anhydride, 3-hydroxyphthalic anhydride, 3-chlorophthalic anhydride, 3-fluorophthalic anhydride, 4-methylphthalic anhydride, 4-t-butylphthalic anhydride, 4-chlorophthalic anhydride, 4-bromophthalic anhydride, 4-fluorophthalic anhydride, 3,6-dichlorophthalic anhydride, 3,6-dimethylphthalic anhydride, 3,6-difluorophthalic anhydride, 4,5-difluorophthalic anhydride, 4,5-dichlorophthalic anhydride, 1,2-naphthoic anhydride, 2,3-naphthoic anhydride, tetrabromophthalic anhydride, tetrachlorophthalic anhydride, tetraiodophthalic anhydride, tetrafluorophthalic anhydride, tetraphenylphthalic anhydride, tetramethylphthalic anhydride, 4-nitrophthalic anhydride, 3-dialkylaminophthalic anhydride, 4-dialkylaminophthalic anhydride.

For the reaction of the mixtures of m-aminophenol derivatives, as above mentioned, with phthalic anhydrides, the latter is usually used in an amount of 0.5–2.0 moles per total moles of the m-aminophenol derivatives. The ratio of solvent to m-aminophenol derivatives may be between 0 and 20 parts by weight. The quantity of solvent chosen is dependant on the nature of the m-aminophenol derivatives. The amount of solvent used is determined so that the reaction mass remains mobile throughout the course of the reaction. Preferably, the product is precipitated during the reaction. The reaction is effected at an elevated temperature, preferably in the range of 60–120° C. for a period of 3–40 hours. The reaction time, solvent ratio and temperature are chosen so as to achieve a suitable balance between length of reaction and the amount of rhodamine type side products that are produced. The amount of rhodamine produced increases at higher temperatures. After the reaction, the reaction mixture is cooled to 0–60° C., most preferably 20–40° C. Dependent on the viscosity of the reaction mixture at this stage, a secondary solvent may be added to the reaction mixture to maintain mobility.

There may be used as the secondary solvent, for example, an aromatic hydrocarbon of 6–10 carbon atoms such as benzene, toluene or xylene, an aliphatic hydrocarbons of 5–12 carbons such as pentane, octane, isooctane, or decane, a halogenated aliphatic, cycloaliphatic or aromatic hydrocarbon of 2–8 carbons, such as perclene, chlorobenzene or dichlorobenzene, ethers such as tetrahydrofuran, dibutyl ether or diphenylether, alcohols such as methanol, ethanol, propanols such as isopropanols or butanols such as n-butanol. There may also be used a mixture of the alcohol with water or a mixture of the alcohol with a hydrocarbon solvent.

The crude keto acid derivative may be recovered from the reaction mixture by filtration, or by diluting the mixture with a solvent in which the derivative is barely soluble and recovering the precipitated derivative by filtration, or by extracting the derivative with an aqueous alkaline solution and precipitating it with acid, or by forming the sodium salt of the derivative, isolating the salt and precipitating it with acid.

The organic solvents when used include, for example, an aromatic hydrocarbon of 6–10 carbon atoms such as benzene, toluene or xylene, an aliphatic hydrocarbons of 8–12 carbons such as octane, isooctane, or decane, a halogenated hydrocarbon of 2–8 carbons, aliphatic, cycloaliphatic or aromatic, such as perclene, chlorobenzene or dichlorobenzene, ethers such as tetrahydrofuran, dibutyl ether or diphenylether, among which are especially preferred aromatic hydrocarbons or ethers.

The mixture of keto acids of general formula (II) thus isolated can then be reacted with a diphenylamine of general formula (III), as described previously, to produce a monophase solid solution of formula (I). In this instance the composition of the monophase solid solution isolated is determined by the ratio of the amino phenols used.

If desired, the solid solution, suitably isolated by any of the aforementioned methods, may be further purified by precipitation from an organic solvent or from a organic solvent-water mixture, for example, toluene, benzene, xylene, methanol, ethanol, iso-propanol, n-butanol, acetonitrile, dimethylformamide or mixtures of these solvents. The crystal may be dissolved by heating to a temperature range of from room temperature to the boiling point of the chosen solvent, or above it under pressure in an autoclave. After complete dissolution the crystal may be precipitated with stirring or on standing.

All of the methods of preparation as hereinbefore described can be used to produce the novel monophase solid solutions of two or more fluoran compounds according to the present invention. Whether or not a monophase solid solution has been formed may be judged by powder X-ray diffraction analysis using K-Cuα rays. A powder X-ray diffraction pattern of a monophase solid solution is substantially identical to that of one of the components, the 'host'. In general the 'host' is the compound forming the greater part of the mixture. A monophase solid solution may also demonstrate a different melting point to that of an equivalent physical mixture. However, a change in melting point may also indicate a mixed crystal has been formed, thus melting point should only be considered in conjunction with powder X-ray diffraction when assessing whether or not a monophase solid solution has been formed.

The monophase solid solution of the general formula (I), as isolated by any of the processes according to the present invention, may be used as a colour forming compound for various recording materials. Isolated material, as defined herein, means both crystalline material as obtained from precipitate and filtration as well as material which has been further purified, by say, recrystallisation.

As such it is a further object of the present invention to provide recording material comprising the novel monophase solid solutions of general formula (I) according to the present invention. The recording materials of the present invention include pressure sensitive recording material and heat sensitive recording material. The novel monophase solid solutions according to the present invention are particularly suitable for heat sensitive recording materials.

In such cases, the monophase solid solution can be used singly or as a mixture with other colour forming compounds such as triphenylmethanes, lactones, fluorans, benzoxazines and spiropyrans in order to adjust the developed hue if desired. The novel monophase solid solutions of the invention may also be used together with further black colour formers to improve the thermal sensitivity and image stability of the recording material. Other colour formers which may be used as above, include but are not limited to; 3-dibutylamino-7-dibenzylaminofluoran, 3-diethylamino-6-methylfluoran, 3-dimethylamino-6-methyl-7-anilinofluoran, 3-diethylamino-6-methyl-7-anilinofluoran, 3-diethylamino-6-methyl-7-(2,4-dimethylanilino)fluoran, 3-diethylamino-6-methyl-7-chlorofluoran, 3-diethylamino-6-methyl-7-(3-trifluoromethylanilino)fluoran, 3-diethylamino-6-methyl-7-(2-chloroanilino)fluoran, 3-diethylamino-6-methyl-7-(4-chloroanilino)fluoran, 3-diethylamino-6-methyl-7-(2-fluoroanilino)fluoran, 3-diethylamino-6-methyl-7-(4-n-octylanilino)fluoran, 3-diethylamino-7-(4-n-octylanilino) fluoran, 3-diethylamino-7-(n-octylamino)fluoran, 3-diethylamino-6-methyl-7-(dibenzylamino)fluoran, 3-diethylamino-7-(dibenzylamino)fluoran, 3-diethylamino-6-chloro-7-methylfluoran, 3-diethylamino-7-t-butylfluoran, 3-diethylamino-7-carboxyethylfluoran, 3-diethylamino-6-chloro-7-anilinofluoran, 3-diethylamino-6-methyl-7-(3-methylanilino)fluoran, 3-diethylamino-6-methyl-7-(4-methylanilino)fluoran, 3-diethylamino-6-ethoxyethyl-7-anilinofluoran, 3-diethylamino-7-methylfluoran, 3-diethylamino-7-chlorofluoran, 3-diethylamino-7-(3-trifluoromethylanilino)fluoran, 3-diethylamino-7-(2-chloroanilino)fluoran, 3-diethylamino-7-(2-fluoroanilino) fluoran, 3-diethylamino-benzo[a]fluoran, 3-diethylamino-benzo[c]fluoran, 3-dibutylamino-6-methyl fluoran, 3-dibutylamino-6-methyl-7-anilinofluoran, 3-dibutylamino-6-methyl-7-(2,4-dimethylanilino)fluoran, 3-dibutylamino-6-methyl-7-(2-chloroanilino)fluoran, 3-dibutylamino-6-methyl-7-(4-chloroanilino)fluoran, 3-dibutylamino-6-methyl-7-(2-fluoroanilino)fluoran, 3-dibutylamino-6-methyl-7-(3-trifluoromethylanilino)fluoran, 3-dibutylamino-6-ethoxyethyl-7-anilinofluoran, 3-dibutylamino-6-chloro-anilinofluoran, 3-dibutylamino-6-methyl-7-(4-methylanilino)fluoran, 3-dibutylamino-7-(2-chloroanilino)fluoran, 3-dibutylamino-7-(2-fluoroanilino) fluoran, 3-dipentylamino-6-methyl-7-anilinofluoran, 3-dipentylamino-6-methyl-7-(4-2-chloroanilino)fluoran, 3-dipentylamino-7-(3-trifluoromethylanilino)fluoran, 3-dipentylamino-6-chloro-7-anilinofluoran, 3-dipentylamino-7-(4-chloroanilino)fluoran, 3-pyrrolidinomethyl-7-anilinofluoran, 3-piperidino-6-methyl-7-anilinofluoran, 3-(N-methyl-N-propylamino)-6-methyl-7-anilinofluoran, 3-(N-methyl-N-cyclohexylamino)-6-methyl-7-anilinofluoran, 3-(N-ethyl-N-cyclohexylamino)-6-methyl-7-anilinofluoran, 3-(N-ethyl-p-toluidino)-6-methyl-7-anilinofluoran, 3-(N-ethyl-N-isoamylamino)-6-methyl-7-anilinofluoran, 3-(N-ethyl-N-isoamylamino)-6-chloro-7-anilinofluoran, 3-(N-ethyl-N-tetrahydrofurfurylamino)-6-methyl-7-anilinofluoran, 3-(N-ethyl-N-isobutylamino)-6-methyl-7-anilinofluoran, 3-(N-butyl-N-isoamylamino)-6-methyl-7-anilinofluoran, 3-(N-isopropyl-N-3-pentylamino)-6-methyl-7-anilinofluoran, 3-(N-ethyl-N-ethoxypropylamino)-6-methyl-7-anilinofluoran, 3-cyclohexylamino-6-chlorofluoran, 2-methyl-6-p-(p-dimethylaminophenyl)amino-anilinofluoran, 2-methoxy-6-p-(p-dimethylaminophenyl) aminoanilinofluoran, 2-chloro-3-methyl-6-p-(p-phenylaminophenyl)aminoanilinofluoran, 2-diethylamino-6-p-(p-dimethylaminophenyl)aminoanilinofluoran, 2-phenyl-6-methyl-6-p-(p-phenylaminophenyl) aminoanilinofluoran, 2-benzyl-6-p-(p-phenylaminophenyl) aminoanilinofluoran, 3-methyl-6-p-(p-dimethylaminophenyl)aminoanilinofluoran, 3-diethylamino-6-p-(p-diethylaminophenyl) aminoanilinofluoran, 3-diethylamino-6-p-(p-dibutylaminophenyl)aminoanilinofluoran, 2,4-dimethyl-6-[(4-dimethylamino)anilino]fluoran, 3,6,6'-tris (dimethylamino)spiro[fluorene-9,3'-phthalide], 3,6,6'-tris (diethylamino)spiro[fluorene-9,3'-phthalide], 3,3-bis(p-dimethylaminophenyl)-6-dimethylaminophthalide, 3,3-bis (p-dimethylaminophenyl)phthalide, 3,3-bis-[2-(p-dimethylaminophenyl)-2-(p-methoxyphenyl)ethenyl-4,5,6, 7-tetrabromophthalide, 3,3-bis-[2-(p-dimethylaminophenyl)-2-(p-methoxyphenyl)ethenyl-4,5,6, 7-tetrachlorophthalide, 3,3-bis[1,1-bis(4-pyrrolidinophenyl) ethylene-2-yl]-4,5,6,7-tetrabromophthalide, 3,3-bis-[1-(4-methoxyphenyl)-1-(4-pyrridinophenyl)ethylene-2-yl]-4,5,6, 7-tetrachlorophthalide, 3-(4-diethylamino-2-ethoxyphenyl)-3-(1-ethyl-2-methylindole-3-yl)-4-azaphthalide, 3-(4-diethylamino-2-ethoxyphenyl)-3-(1-octyl-2-methylindole-3-yl)-4-azaphthalide, 3-(4-cyclohexylethylamino-2-methoxyphenyl)-3-(1-ethyl-2-methylindole-3-yl)-4-azaphthalide, 3,3-bis(1-ethyl-2-methylindole-3-yl) phthalide, 3,3-bis(1-octyl-2-methylindole-3-yl)phthalide, mixture of 2-phenyl-4-(4-diethylaminophenyl)-4-(4-methoxyphenyl)-6-methyl-7-dimethylamino-3,1-benzoxazine and 2-phenyl-4-(4-diethylaminophenyl)-4-(4-methoxyphenyl)-8-methyl-7-dimethylamino-3,1-benzoxazine, 4,4'-[1-methylethylidene)bis(4,1-phenyleneoxy-4,2-quinazolinediyl)]bis[N,N-diethylbenzenamine], bis(N-methyldiphenylamine)-4-yl-(N-butylcarbazole-3-yl-methane and mixtures thereof.

When preparing a heat sensitive recording material of the invention, the novel monophase solid solutions of the present invention and a developer are pulverised separately in water or a suitable dispersing medium, such as aqueous polyvinyl alcohol, to form an aqueous or other dispersion. Optonally, a fine dispersion of sensitiser may be included. The fine particle dispersions thus obtained are combined and then mixed with conventional amounts of binder, filler and lubricant.

Representative examples of the developer which are suitable for use in the heat sensitive recording material include but are not limited to: substituted phenols and bisphenols such as 4,4'-isopropylidene Bisphenol, 4,4'-sec-butylidene bisphenol, 4,4'-cyclohexylidene Bisphenol, 2,2-bis-(4-hydroxyphenyl)-4-methylpentane, 2,2-dimethyl-3,3-di(4-hydroxyphenyl)butane, 2,2'-dihydroxydiphenyl, 1-phenyl-1, 1-bis(4-hydroxyphenyl)butane, 4-phenyl-2,2-bis(4-hydroxyphenyl)butane, 1-phenyl-2,2-bis(4-hydroxyphenyl) butane, 2,2-bis(4'-hydroxy-3'-methylphenyl)-4-methylpentane, 2,2-bis(4'-hydroxy-3'-tert-butyllphenyl)4-methylpentane, 4,4'-sec-butylidene-bis(2-methylphenol), 4,4'-isopropylidene-bis(2-tert-butylphenol), 2,2-bis(4'-hydroxy-3'-isopropylphenyl)-4-methylpentane, allyl-4,4-bis (4'-hydroxyphenyl)pentanoate, propargyl-4,4-bis(4'-hydroxyphenyl)pentanoate, n-propyl-4,4-bis(4'-hydroxyphenyl)pentanoate, 2,4-bis(phenylsulfonyl)phenol, 2-(4-methylsulfonyl)-4-(phenylsulfonyl)phenol, 2-(phenylsulfonyl)-4-(4-methylsulfonyl)phenol, 2,4-bis(4-methylphenylsulfonyl)phenol, pentamethylene-bis(4-hydroxybenzoate), 2,2-dimethyl-3,3-di(4-hydroxyphenyl) pentane, 2,2-di(4-hydroxyphenyl)hexane; sulphur containing bisphenols such as; 4,4'-dihydroxydiphenyl thioether, 1,7-di(4-hydroxyphenylthio)-3,5-dioxaheptane, 2,2'-bis(4-hydroxyphenylthio)diethyl ether, 4,4'-dihydroxy-3,3'-dimethylphenyl thioether; hydroxybenzoate esters such as; benzyl-4-hydroxybenzoate, ethyl-4-hydroxybenzoate, propyl-4-hydroxybenzoate, isopropyl-4-hydroxybenzoate, butyl-4-hydroxybenzoate, isobutyl-4-hydroxybenzoate; hydroxy sulfones such as; 4,4'-dihydroxydiphenyl sulfone, 2,4'-dihydroxydiphenyl sulfone, 4-hydroxy-4'-methyldiphenyl sulfone, 4-hydroxy-4'-isopropoxydiphenyl sulfone, 4-hydroxy-4'-butoxydiphenyl sulfone, 4,4'-dihydroxy-3,3'-diallyldiphenyl sulfone, 3,4-dihydroxy-4'-methyldiphenyl sulfone, 4,4'-dihydroxy-3,3',5,5'-tetrabromodiphenyl sulfone; sulphonyl ureas such as 4,4'-bis(p-toluenesulphonylaminocarbonylamino) diphenylmethane; diesters of 4-hydroxyphthalic acid such as; dimethyl 4-hydroxyphthalate, dicyclohexyl 4-hydroxyphthalate, diphenyl 4-hydroxyphthalate; salicylic acid derivatives such as; 4-[2-(4-methoxyphenyloxy) ethyloxy]salicylate, 3,5-di-tert-butylsalicylic acid, 3-benzyl salicylic acid, 3-(α-methylbenzyl)salicylic acid, 3-phenyl-5-(α,α-dimethylbenzyl)salicylic acid, 3,5-di-α-methylbenzyl salicylic acid; metal salts of salicylic acid such as zinc salicylate; benzoic acid derivatives such as; 2-benzylsulfonylbenzoic acid, 3-cyclohexyl-4-hydroxybenzoic acid; metal salts of benzoic acid such as; zinc benzoate, zinc 4-nitrobenzoate resorcylic anilide derivatives as described in U.S. Pat. No. 5,607,894 and included herein by reference; phthalic acid and isophthalic acid derivatives such as; 4-(4'-phenoxybutoxy)phthalic acid, 4-(2'-phenoxyethoxy)phthalic acid, 4-(3'-phenylpropyloxy) phthalic acid, mono (2-hydroxyethyl)-5-nitro-isophthalic acid, 5-benzyloxycarbonyl isophthalic acid, 5-(1'-phenylethanesulfonyl)isophthalic acid and bis(1,2-dihydro-1,5-dimethyl-2-phenyl-3H-pyrrol-3-one-O)bis(thiocyanato-N) zinc and mixtures thereof.

Representative binders used for the heat sensitive recording material includes, but are not iimited to; polyvinyl alcohol (fully and partially hydrolysed), carboxy, amide, sulfonic and butyral modified polyvinyl alcohols, derivatives of cellulose such as hydroxyethyl cellulose, methyl cellulose, ethyl cellulose, carboxymethyl cellulose and acetyl cellulose, copolymer of styrene-maleic anhydride, copolymer of styrene-butadiene, polyvinyl chloride, polyvinyl acetate, polyacrylamide, polyamide resin and mixtures thereof.

Exemplary fillers which can be used include, but are not limited to; calcium carbonate, kaolin, calcined kaolin, aluminium hydroxide, talc, titanium dioxide, zinc oxide, silica, polystyrene resin, urea-formaldehyde resin, hollow plastic pigment and mixtures thereof.

Representative lubricants for use in heat sensitive recording materials include, but are not limited to; dispersions or emulsions of stearamide, methylene bisstearamide, polyethylene, camauba wax, paraffin wax, zinc stearate or calcium stearate and mixtures thereof.

Other additives can also be employed, if necessary. Exemplary additives include sensitisers, stabilisers and the like.

Representative sensitisers for use in heat sensitive recording materials include but are not limited to; stearamide, methylol stearamide, p-benzylbiphenyl m-terphenyl, 2-benzyloxynaphthalene, dibenzyl oxalate, di(4-methylbenzyl)oxalate, di(4-chlorobenzyl)oxalate, dimethyl phthalate, dibenzyl terephthalate, dibenzyl isophthalate, 1,2-diphenoxyethane, 1,2-bis(4-methylphenoxy)ethane, 1,2-bis (3-methylphenoxy)ethane, 4,4'-dimethylbiphenyl, phenyl-1-hydroxy-2-naphthoate, 4-methylphenyl biphenyl ether, 1,2-bis(3,4-dimethylphenyl)ethane, 2,3,5,6-4'-methyldiphenyl methane, 1,4-diethoxynaphthaiene, o-xylylene-bis(phenyl ether), 4-(m-methylphenoxymethyl)biphenyl, p-hydroxyacetanilide, p-hydroxybutyranilide, p-hydroxynonananilide, p-hydroxylauranilide, p-hydroxyoctadecananilide and mixtures thereof.

Representative stabilisers for use in heat sensitive recording materials include but are not limited by; 2,2'-methylene-bis(4-methyl-6-tert-butylphenol), 2,2'-methylene-bis(4-ethyl-6-tert-butylphenol), 4,4'-butylidene-bis(3-methyl-6-tert-butylphenol), 4,4'-thio-bis(2-tert-butyl-5-methylphenol), 1,1,3-tris(2-methyl-4-hydroxy-5-tert-butylphenyl)butane, 1,1,3-tris(2-methyl-4-hydroxy-5-cyohexylphenyl)butane, bis(3-tert-butyl-4-hydroxymethylphenyl)sulfone, bis(3,5-dibromo-4-hydroxyphenyl)sulfone, 4,4'-sulfinyl bis(2-tert-butyl-5-methylphenol), 2,2'-methylene bis(4,6-di-tert-butylphenyl) phosphate and alkali metal, ammonium and polyvalent metal salts thereof, 4-benzyloxy-4'-(2-methylglycidyloxy) diphenyl sulfone, 4,4'-diglycidyloxydiphenyl sulfone, 1,4-diglycidyloxybenzene, 4-[α-(hydroxymethyl)benzyloxy]-4-hydroxydiphenyl sulfone, metal salts of p-nitrobenzoic acid, metal salts of phthalic acid mono benzyl ester, metal salts of cinnamic acid and mixtures thereof.

The coating liquid obtained by the addition of additives to the particle dispersion of fluoran and developer can be applied to a suitable substrate such as paper, plastic sheet and resin coated paper, and used as the heat sensitive recording material. The system of the invention can be employed for other end use applications using colour forming materials, for example, a temperature indicating material.

The mixtures of fluorans of the present invention may also be used in conventional pressure sensitive recording materials as described in GB 2,000,206 and GB 2,068,994. They may be used alone or in combination with other colour forming materials such as those listed previously herein. In pressure sensitive recording materials, a solution of colour formers is allowed to come into contact with an acidic developer to produce the image. Typical solvents used include but are not limited to; diisopropyl naphthalene, butylated biphenyls, isopropylated biphenyls, phenyl xylyl ethane, butylated diphenylethane, xylenyl xylene, esters of trimethylol propane, biodegradable solvents of natural or synthetic origin such as rapeseed oil, sunflower oil, coconut oil, palm oil, dialkyl esters of carboxylic acids such as adipic acid, sebacic acid and azaleic acid. The solvent may be diluted with diluents exemplified by, but not limited to; kerosenes, normal paraffins and naphthenic oils. Typical developers include but are not limited to; activated bentonite, activated montmorillonite, synthetic aluminosilicates, phenolic resins especially Zinc modified phenolic resins, attapulgite clay, Silton clay and zinc salicylates.

Preferably, the colour former solution is encapsulated in microcapsules thus preventing contact with the developer and premature image development. Typical microcapsule wall materials include but are not limited to; gelatine, melamine-formaidehyde(MF), urea-formaldehyde(UF), MF-UF, polyurea, polyurethane and polyamide. Typically, the microcapsules containing the colour former may be coated on to a sheet of paper (coated back or CB) and the developer may be coated onto a separate sheet of paper (coated front or CF). The imaging set may then be formed by bringing together the two coated papers with the coated surfaces in contact with each other. Pressure may then be applied to the reverse of the CB to rupture the microcapsules and allow the colour former solution to come into contact with the developer on the CF and form the desired image. If more than one copy is required, one or more intermediate sheets, usually known as CFB (coated front and back) sheets are provided, each of which is coated on its' lower surface with microcapsules and on its' upper surface with colour developer composition. The microcapsules and colour developing material may also be coated onto the same surface of a sheet usually known as a self-contained system.

The following non-limibng examples, illustrate the novel materials of the present invention;

EXAMPLE 1

Preparation of monophase solid solution from 3-diethylamino-6-methyl-7-anilino fluoran (10 mol %) and 3-dibutylamino-6-methyl-7-anilino fluoran (90 mol %)

To 250 ml of toluene was added 3-dibutylamino-6-methyl-7-anilino fluoran (24 g, 0.045 mol) and 3-diethylamino-6-methyl-7-anilino fluoran (2.4 g, 0.0045 mol) and the mixture was heated to solution. To this was added 1.0 g sodium hydroxide solution (47% w/w). Toluene was then removed by vacuum distillation, constant weight was maintained by addition of water. The precipitate was then isolated by filtration and washed with methanol (2×100 ml) to provide 24 g of a white powder (melting point 178–179° C.), a monophase solid solution, which gave an XRD pattern identical to that of 3-dibutylamino-6-methyl-7-anilino fluoran with high peaks at 2θ=6.2, 6.8, 10.9, 15.8, 17.3, 18.4, 18.9, 20.3, 22.2, 22.3, 23.9.

Comparative Example 1

Preparation of a Physical Mixture of Fluorans

A physical mixture of 3-dibutylamino-6-methyl-7-anilino fluoran (24 g, 0.045 mol) and 3-diethylamino-6-methyl-7-anilino fluoran (2.4 g, 0.0045 mol) was prepared by combining the two fluorans in a pestle and mortar and grinding them together. The resulting physical mixture gave an XRD pattern substantially different from that of either constituent fluoran and the monophase solid solution of example 1. The x-ray powder diffraction pattern showed high peaks at 2θ=6.2, 6.9, 11.0, 13.8, 16.4, 18.4, 18.9.

EXAMPLE 2

Preparation of the monophase solid solution of example 1 from 2'-carboxy-4-dibutylamino-2-hydroxybenzophenone (90 mol %) and 2'-carboxy-4-diethylamino-2-hydroxybenzophenone(10 mol %)

To 249.5 g of 98% sulphuric acid and 61.2 g oleum was added, 78.97 g of 2'-carboxy-4-dibutylamino-2-hydroxybenzophenone and 7.44 g of 2'-carboxy-4-diethylamino-2-hydroxybenzophenone over about 2 hr with the temperature being maintained below about 25° C. by use of an ice-bath. Once insolution, 50.7 g of 4-methoxy-2-methyldiphenylamine was added and the mixture was stirred for about 3 hr at 30° C. The reaction mass was then added, over about 30 minutes with stirring, to a mixture of 135 g toluene-45 g water at 85° C. To this was then added, over 30 minutes, 135.7 g water. Agitation was ceased and the separated aqueous phase was removed. To the remaining organic phase was added 244 g sodium hydroxide 100°TW, 199 g toluene and 387 g water and the reaction was stirred for 2 h at 85° C. The reaction was cooled to 25° C. and the precipitated product was isolated by filtration. The product was washed with hot water (about 60° C.) then methanol and dried to yield 106.2 g of a monophase solid solution of the invention (melting point 179.9–181.4° C.).

EXAMPLE 3

Preparation of a monophase solid solution from 3-N-(1-ethylpropyl)-N-propylaminophenol (90 mol %) and 3-N,N-diethylaminophenol (10 mol %)

An amount of 3.3 g (0.02 mol) of N,N-diethylaminophenol, 39.8 g (0.18 mol) 3-N-(1-ethylpropyl)-N-propylaminophenol, 32.6 g(0.22 mol)phthalic anhydride and 46 g of toluene were placed in a reactor, and stirred whilst the reaction mass was heated to 90° C. over 2 hours and then heated to 85° C. and stirred at this temperature for 12 hours. Toluene 40 g was added and the reaction mass cooled to 20° C. The product was isolated by filtration. The crude product was washed with methanol to yield 41.6 g of the mixed keto acid. The mixed keto acid was then converted to a monophase solid solution of the invention as described in example 1.

The tabulated examples were prepared following example 1 using the fluorans indicated, in each case a monophase solid solution was obtained, the X-ray diffraction pattern being substantially identical to that of the major component.

| Eg | Colour Former | mol % | Colour Former | mol % | mpt ° C. |
|---|---|---|---|---|---|
| 4 | 3-Dibutylamino-6-methyl-7-anilinofluoran | 99.9 | 3-Diethylamino-6-methyl-7-anilinofluoran | 0.1 | 182.6–183.7 |
| 5 | 3-Dibutylamino-6-methyl-7-anilinofluoran | 99 | 3-Diethylamino-6-methyl-7-anilinofluoran | 1 | 182.4–182.8 |
| 6 | 3-Dibutylamino-6-methyl-7-anilinofluoran | 95 | 3-Diethylamino-6-methyl-7-anilinofluoran | 5 | 179–182 |
| 7 | 3-Dibutylamino-6-methyl-7-anilinofluoran | 85 | 3-Diethylamino-6-methyl-7-anilinofluoran | 15 | |
| 8 | 3-Dibutylamino-6-methyl-7-anilinofluoran | 80 | 3-Diethylamino-6-methyl-7-anilinofluoran | 20 | 167–172 |
| 9 | 3-Dibutylamino-6-methyl-7-anilinofluoran | 90 | 3-DiMethylamino-6-methyl-7-anilinofluoran | 10 | 174.5–178.8 |
| 10 | 3-Dibutylamino-6-methyl-7-anilinofluoran | 95 | 3-N-isoamyl-N-ethylamino-6-methyl-7-anilinofluoran | 5 | 182.5–183 |
| 11 | 3-Dibutylamino-6-methyl-7 anilinofluoran | 90 | 3-N-isoamyl-N-ethylamino-6-methyl-7-anilinofluoran | 10 | 178–178.4 |
| 12 | 3-Dibutylamino-6-methyl-7-anilinofluoran | 80 | 3-N-isoamyl-N-ethylamino-6-methyl-7-anilinofluoran | 20 | 171.5–172.2 |
| 13 | 3-Dibutylamino-6-methyl-7-anilinofluoran | 90 | 3-N-cyclohexyl-N-methylamino-6-methyl-7-anilinofluoran | 10 | 181.5–182 |
| 14 | 3-Diethylamino-6-methyl-7-anilinofluoran | 10 | 3-N-isoamyl-N-ethylamino-6-methyl-7-anilinofluoran | 90 | 163.3–164 |
| 15 | 3-Diethylamino-6-methyl-7-anilinofluoran | 20 | 3-N-isoamyl-N-ethylamino-6-methyl-7-anilinofluoran | 80 | 156–157 |
| 16 | 3-Diethylamino-6-methyl-7-anilinofluoran | 80 | 3-N-isoamyl-N-ethylamino-6-methyl-7-anilinofluoran | 20 | 183–184.5 |

-continued

| Eg | Colour Former | mol % | Colour Former | mol % | mpt ° C. |
|---|---|---|---|---|---|
| 17 | 3-Diethylamino-6-methyl-7-anilinofluoran | 90 | 3-N-isoamyl-N-ethylamino-6-methyl-7-anilinofluoran | 10 | 192–192.7 |
| 18 | 3-Diethylamino-6-methyl-7-anilinofluoran | 90 | 3-N-Propyl-N-methylamino-6-methyl-7-anilinofluoran | 10 | 191.9–192.6 |
| 19 | 3-Diethylamino-6-methyl-7-anilinofluoran | 80 | 3-N-Propyl-N-methylamino-6-methyl-7-anilinofluoran | 20 | 189–191 |
| 20 | 3-Diethylamino-6-methyl-7-anilinofluoran | 20 | 3-N-Propyl-N-methylamino-6-methyl-7-anilinofluoran | 80 | 167.6–168.6 |
| 21 | 3-Diethylamino-6-methyl-7-anilinofluoran | 10 | 3-N-Propyl-N-methylamino-6-methyl-7-anilinofluoran | 90 | 173.6–174.2 |
| 22 | 3-Diethylamino-6-methyl-7-anilinofluoran | 80 | 3-Diethyl-amino-6-methyl-7-(3-tolyl) aminofluoran | 20 | 196.3–197.8 |
| 23 | 3-Diethylamino-6-methyl-7-anilinofluoran | 90 | 3-Diethyl-amino-6-methyl-7-(3-tolyl) aminofluoran | 10 | 195.1–197 |
| 24 | 3-Dibutylamino-6-methyl-7-anilinofluoran | 90 | 3,3-bis(1-octyl-2-methylindol-3-yl)phthalide | 10 | 177–178 |
| 25 | 3-Dibutylamino-6-methyl-7-anilinofluoran | 80 | 3,3-bis(1-octyl-2-methylindol-3-yl)phthalide | 20 | 173.2–174 |
| 26 | 3-Dibutylamino-6-methyl-7-anilinofluoran | 90 | mixture of 2-phenyl-4-(4-diethylamino-phenyl)-4-(4-methoxy-phenyl)-6-methyl-7-dimethylamino-3,1-benzoxazine and 2-phenyl-4-(4-diethyl-aminophenyl)-4-(4-methoxy-phenyl)-8-methyl-7-dimethylamino-3,1-benzoxazine | 10 | 180–181.3 |
| 27 | 3-Dibutylamino-6-methyl-7-anilinofluoran | 80 | mixture of 2-phenyl-4-(4-diethylamino-phenyl)-4-(4-methoxy-phenyl)-6-methyl-7-dimethylamino-3,1-benzoxazine and 2-phenyl-4-(4-diethyl-aminophenyl)-4-(4-methoxy-phenyl)-8-methyl-7-dimethylamino-3,1-benzoxazine | 20 | 166–168 |

-continued

| Eg | Colour Former | mol % | Colour Former | mol % | mpt ° C. |
|---|---|---|---|---|---|
| 28 | 3-Dibutylamino-6-methyl-7-anilinofluoran | 90 | 4,4'-[1-methyl-ethylidene)bis (4,1-phenylen-eoxy-4,2-quin-azolinediyl)]bis [N,N-diethyl-benzenamine] | 10 | 173–175 |
| 29 | 3-Dibutylamino-6-methyl-7-anilinofluoran | 80 | 4,4'-[1-methyl-ethylidene)bis (4,1-phenylen-eoxy-4,2-quin-azolinediyl)]bis [N,N-diethyl-benzenamine] | 20 | 164–166 |
| 30 | 3-Dibutylamino-6-methyl-7-anilinofluoran | 95 | 3-Dibutyl-amino-7-diben-zylamino-fluoran | 5 | 181–183 |

A heat sensitive recording material including a monophase solid solution according to the present invention was prepared as follows:

EXAMPLE 31

Preparation of heat sensitive coating formulations comprising the monophase solid solution of the invention.

Dispersions A–C were prepared by grinding the compositions shown below in an attritor until an average particle size of 1$\mu$ was attained.

Dispersion A (Colour Former)

| | |
|---|---|
| Monophase solid solution of Example 1 | 3.01 parts |
| Polyvinyl alcohol (10% aq. soln.) | 10.50 parts |
| Water | 6.49 parts |

Dispersion B (Colour Developer)

| | |
|---|---|
| Bis Phenol A | 7.5 parts |
| Polyvinyl alcohol (10% aq. soln.) | 7.5 parts |
| Water | 22.5 parts |

Dispersion C (Sensitiser)

| | |
|---|---|
| p-Benzylbiphenyl | 10.0 parts |
| Polyvinyl alcohol (10% aq. soln.) | 10.0 parts |
| Water | 20.0 parts |

A thermal coating mixture was then prepared by combining together the following components

| | parts by weight |
|---|---|
| Dispersion A | 6.6 |
| Dispersion B | 10.0 |
| Dispersion C | 6.0 |
| Calcium Carbonate (25% aq. dispersion) | 12.0 |
| Zinc stearate (33% aq. dispersion) | 0.9 |
| Polyvinyl alcohol (10% aq. soln.) | 4.5 |
| Tinopal ® ABP-X (fluorescent whitening agent) | 0.12 |
| Water | 2.48 |

This coating mixture was applied on one side of a base paper weighing 50 g/m2 in a coating weight of about 5.0 g/m2 and then dried. The resulting sheet was calendered by means of a laboratory calender to produce a recording sheet with excellent background whiteness.

EXAMPLE 32

The procedure of example 31 was repeated using the physical mixture prepared in comparative example 1 in place of the monophase solid solution of the invention.

To illustrate the excellent background whiteness, sensitivity and moisture and heat resistance properties of the heat sensitive recording material prepared by using the monophase solid solution of the present invention its performance was compared with a conventionally used equivalent physical mixture (example 32) as disclosed in U.S. Pat. No. 4,226,912 and conventionally used single colour former 3-dibutylamino-6-methyl-7-anilino fluoran (Pergascript Black T-2R).

TABLE 1

| Coating Formulation on heat sensitive paper | Dynamic Sensitivity | Image: Plasticiser Resistance | Image: Water Resistance | Background Whiteness: Post application | Background Whiteness: Light Resistance | Background Whiteness: Moisture and Heat Resistance |
|---|---|---|---|---|---|---|
| Example 31 | 1 | 1 | 1 | 1 | 1 | 1 |
| Example 32 | 2 | 2 | 2 | 2 | 2 | 1 |
| Pergascript Black T-2R | 3 | 3 | 1 | 1 | 1 | 2 |

Results were evaluated by visual observation. 1 indicates the best perfomer and 3 the worst. Equal ranking indicates a similar performance.

Table 1 illustrates that the heat sensitive recording paper obtained by a process of the invention demonstrates excellent background whiteness (brightness) of paper after application of the coating liquid and in storage stability, i.e.resistance to light, heat and moisture, of uncoloured portion of the coated paper and good resistance of the image to water and plasticiser. Additionally, the recording paper obtained shows a high dynamic sensitivity.

Evaluation of water resistance was conducted by immersing a facsimile image in de-ionised water for 24 hours at room temperature and then observing the remaining image density.

Evaluation of plasticiser resistance was made by contacting a facsimile image with a sheet of PVC under 100 $gcm^{-2}$ pressure for 5 hours at 50° C. and observing the remaining image density.

Evaluation of sensitivity was done using an Infotec fax machine 3301 at pulse widths of 0.30, 0.50, 0.68 and 1.00 milliseconds.

Evaluation post application was conducted by observing the brightness of the paper.

Evaluation of light resistance was conducted by inspecting the degree of yellowing of the uncoloured portion of the paper after exposure to 120 hours of artificial daylight.

Evaluation of heat and moisture resistance was conducted by examining the soiling of the uncoloured portion of paper after storage at 60° C. and 50% relative humidity for one hour.

EXAMPLE 33

Evaluation of the use of monophase solid solutions of the invention in pressure sensitive recording material.

2% solutions of monophase solid solutions of the present invention were prepared in diisopropylnaphthaleneikerosene (70:30 w/w). These solutions were then gravure printed on to commercially available clay, phenolic resin and zinc salicylate CF papers. After one hour, the L*, a* and b* values were measured using a Gretag SPM 50 spectrophotometer.

| Example | CF | L* | a* | b* |
|---|---|---|---|---|
| Monophase solid solution of example 1 | Clay | 58.6 | 6.05 | −5.03 |
| Monophase solid solution of example 1 | Zinc salicylate | 63.56 | 6.22 | 3.82 |
| Monophase solid solution of example 1 | Phenolic | 62.30 | 5.99 | 1.06 |

The L*, a*, b* values obtained demonstrate the ability of the monophase solid solutions of the invention to be used in pressure sensitive copying systems.

Figure 1:
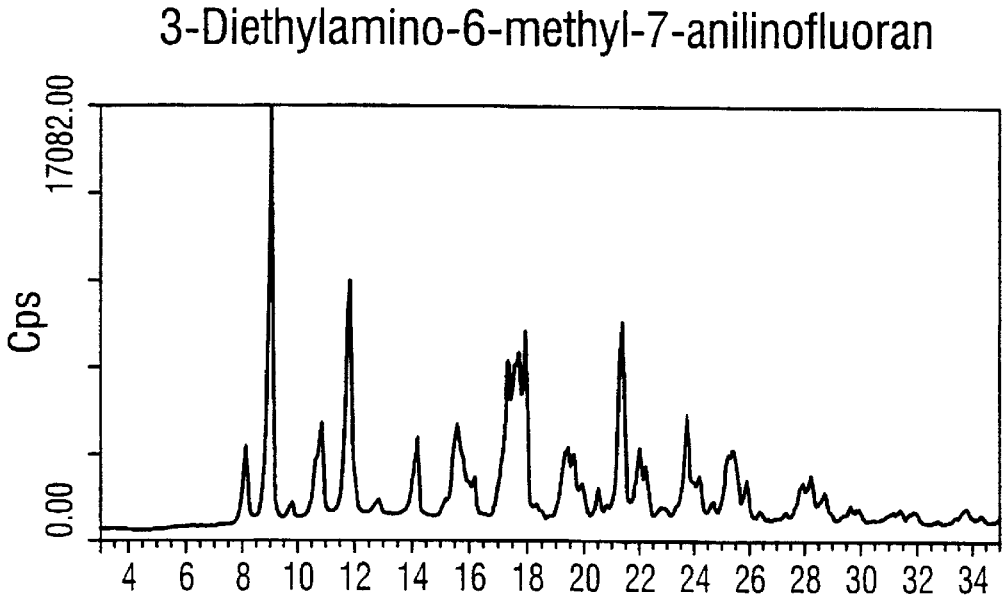
FIGS. 1–3 and 5–7 are X-ray powder diffraction diagrams of the known fluoran compounds and physical mixtures named. In each case the axis of abscissa indicates an angle of diffraction (2θ) and the axis of ordinate indicates strength of diffraction.
Figure 2:
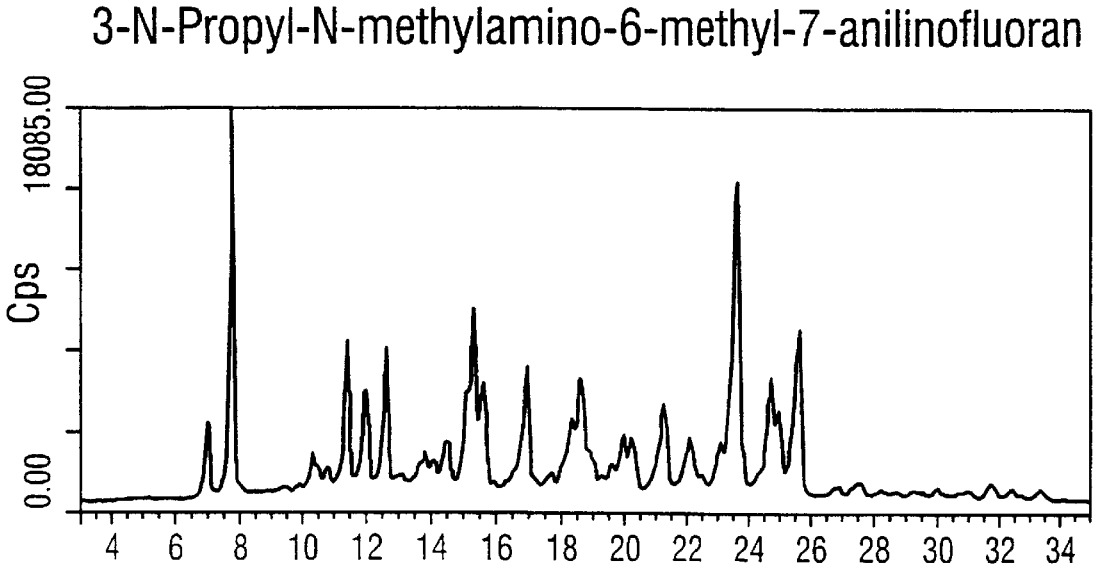
Figure 3:
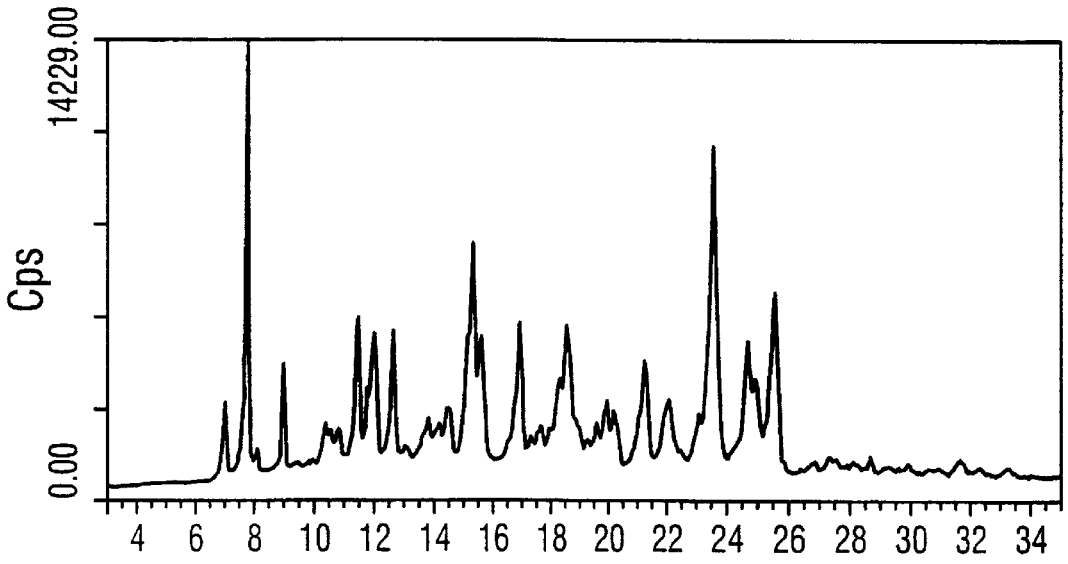
Figure 4:
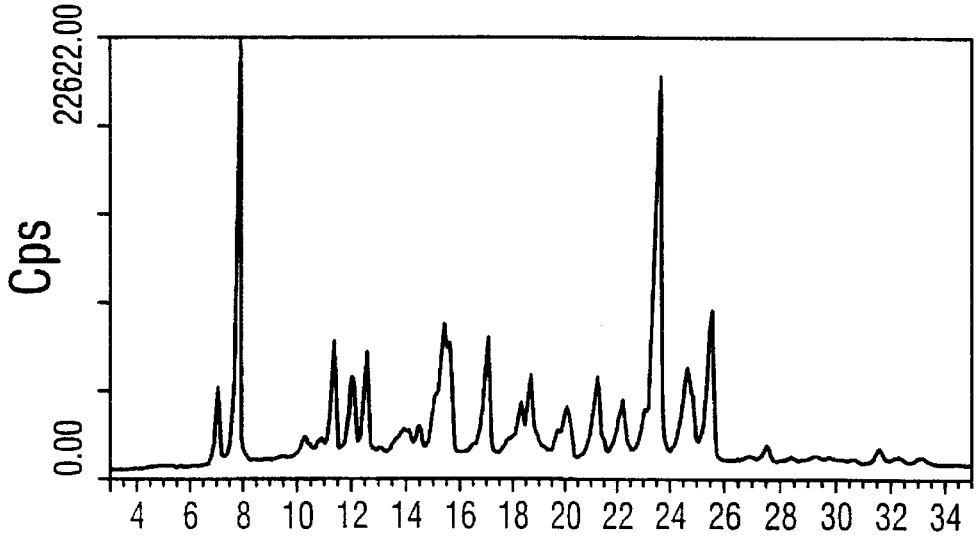
FIGS. 4 and 8 are X-ray powder diffraction diagrams of novel monophase solid solution of formula (I) which were prepared and isolated according to the process of the present invention as illustrated in Examples 1–30.
Figure 5:
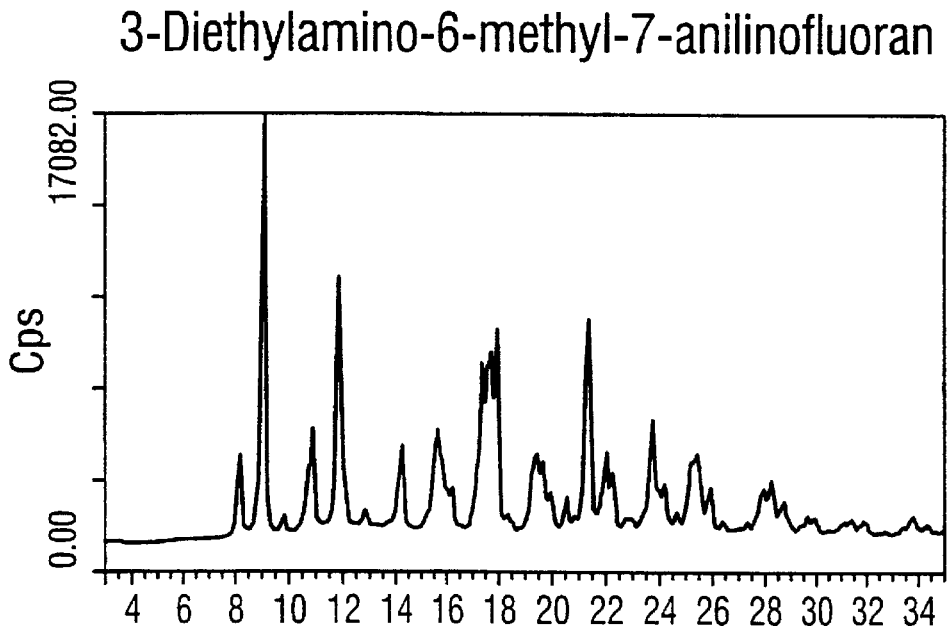
Figure 6:
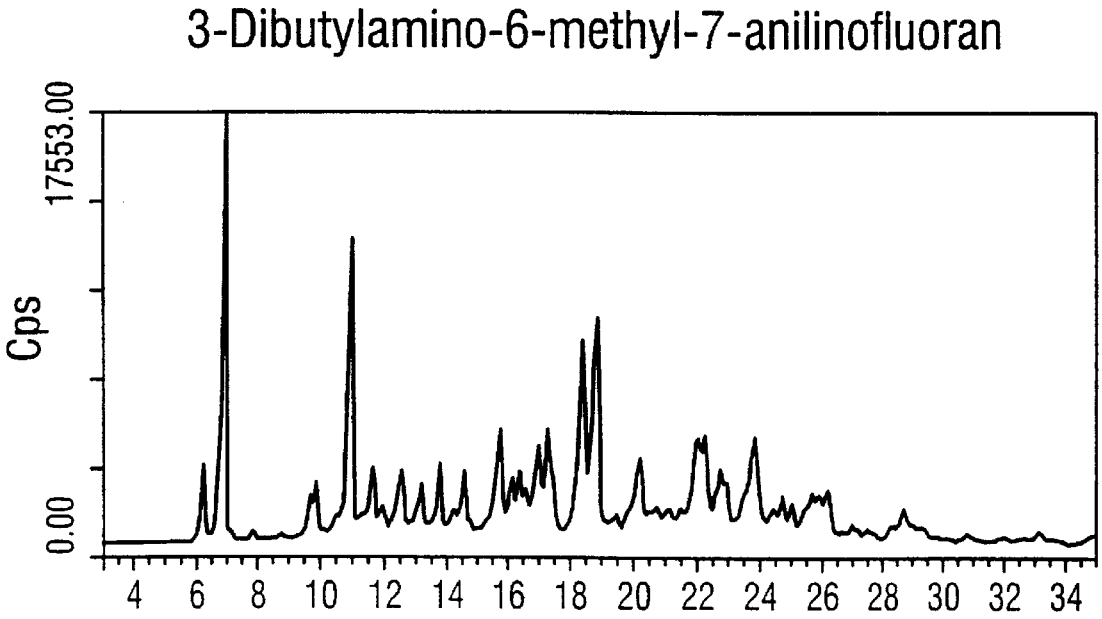
Figure 7:
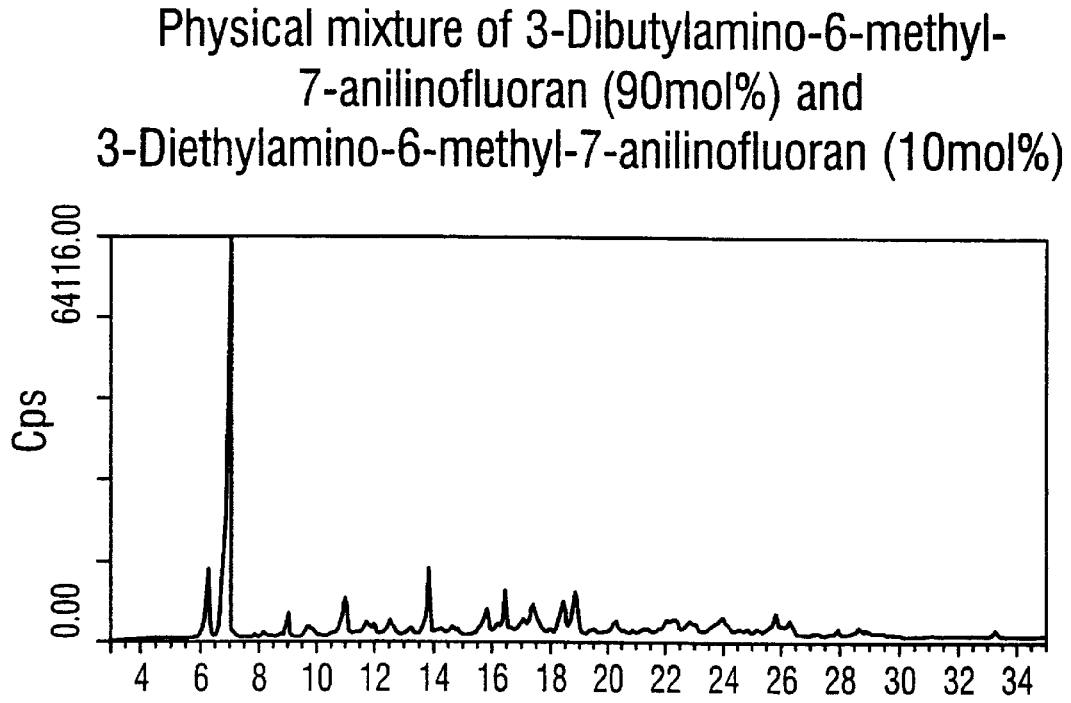
Figure 8:
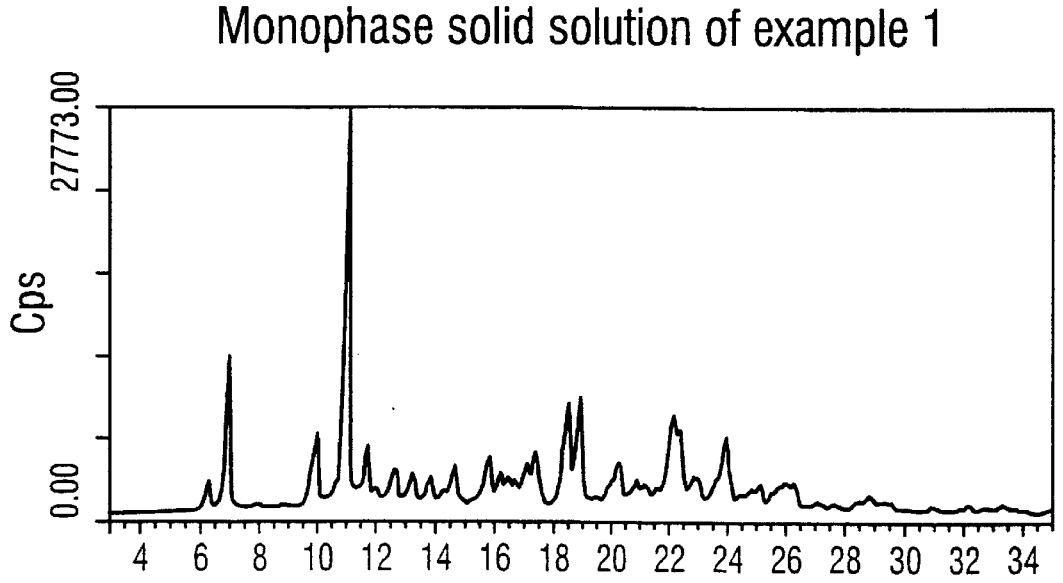

What is claimed is:

1. A monophase solid solution comprising a plurality of colour former compounds.

2. A monophase solid solution according to claim 1 wherein the colour forming materials are selected from the group consisting of fluorans, phthalides, phenoxazines, phenothiazines, rhodamine lactams, leuco-auramines, triphenylmethanes, spiropyrans, benzoxazines and quinozolines, and mixtures thereof.

3. A monophase solid solution according to claim 2 wherein the colour forming materials are selected from the group consisting of fluoran and phthalide colour formers and mixtures thereof.

4. A monophase solid solution according to claim 1 wherein the monophase solid solution comprises at least two fluoran type colour former compounds of the general formula (I):

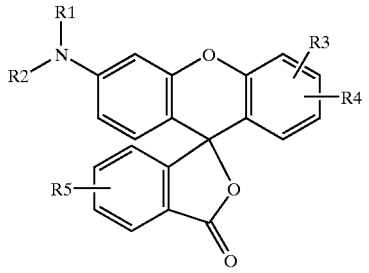

wherein

R1 and R2 independently represent hydrogen; alkyl of 1–18 carbon atoms, a secondary alkyl with respect to the carbon atom bonded to the nitrogen atom of 3–13 carbon atoms; a cycloalkyl of 4–8 carbon atoms or a phenyl, both of which may be substituted by at least one substituent selected from the group consisting of halogen atoms and alkyls having 1–4 carbon atoms, an aralkyl of 7–10 carbon atoms; or R1 and R2, together with the adjacent nitrogen atom form a heterocyclic ring;

R3 is hydrogen; an alkyl of 1–4 carbon atoms; an alkoxy of 1–4 carbon atoms; a phenyl; a substituted phenyl or a halogen;

R4 is an alkyl group of 1–18 carbon atoms; a carboxyalkyl of 1–18 carbon atoms; a carboxycycloalkyl of 4–8 carbon atoms; an alkylamino of 1–18 carbon atoms; a cycloalkylamino of 4–8 carbon atoms; a dialkylamino or dicycloalkylamino; an arylamino; a substituted arylamino; an aralkylamino of 7–10 carbon atoms; a diaralkylamino; and R5 is an alkyl of 1–18 carbon atoms; a carboxy alkyl of 1–18 carbon atoms or a halogen.

5. A monophase solid solution according to claim 1 comprising two components A and B wherein the ratio of the components A to B is in the range of from 0.1–99% by mole of A in B and visa versa.

6. A monophase solid solution according to claim 3 comprising two components A and B wherein the ratio of the components A to B is in the range of from 0.1 to 30% by mole of A in B and visa versa.

7. Monophase solid solutions according to claim 1 comprising two components A and B in the stated ratios:

3-dibutylamino-6-methyl-7-anilinofluoran (95%), 3-dibutylamino-7-dibenzylaminofluoran (5%);
3-dibutylamino-6-methyl-7-anilinofluoran (99.9%), 3-diethylamino-6-methyl-7-anilinofluoran (0.1%);
3-dibutylamino-6-methyl-7-anilinofluoran (99%), 3-diethylamino-6-methyl-7-anilinofluoran (1%);
3-dibutylamino-6-methyl-7-anilinofluoran (95%), 3-diethylamino-6-methyl-7-anilinofluoran (5%);
3-dibutylamino-6-methyl-7-anilinofluoran (90%), 3-diethylamino-6-methyl-7-anilinofluoran (10%);
3-dibutylamino-6-methyl-7-anilinofluoran (85%), 3-diethylamino-6-methyl-7-anilinofluoran (15%);
3-dibutylamino-6-methyl-7-anilinofluoran (80%), 3-diethylamino-6-methyl-7-anilinofluoran (20%);
3-dibutylamino-6-methyl-7-anilinofluoran (95%), 3-N-isoamyl-N-ethylamino-6-methyl-7-anilinofluoran (5%);
3-dibutylamino-6-methyl-7-anilinofluoran (90%), 3-N-isoamyl-N-ethylamino-6-methyl-7-anilinofluoran (10%);
3-dibutylamino-6-methyl-7-anilinofluoran (80%), 3-N-isoamyl-N-ethylamino-6-methyl-7-anilinofluoran (20%);
3-dibutylamino-6-methyl-7-anilinofluoran (90%), 3-N-cyclohexyl-N-methylamino-6-methyl-7-anilinofluoran (10%);
3-diethylamino-6-methyl-7-anilinofluoran (90%), 3-N-isoamyl-N-ethylamino-6-methyl-7-anilinofluoran (10%);
3-diethylamino-6-methyl-7-anilinofluoran (80%), 3-N-isoamyl-N-ethylamino-6-methyl-7-anilinofluoran (20%);
3-diethylamino-6-methyl-7-anilinofluoran (20%), 3-N-isoamyl-N-ethylamino-6-methyl-7-anilinofluoran (80%);
3-diethylamino-6-methyl-7-anilinofluoran (10%), 3-N-isoamyl-N-ethylamino-6-methyl-7-anilinofluoran (90%);
3-diethylamino-6-methyl-7-anilinofluoran (90%), 3-N-propyl-N-methylamino-6-methyl-7-anilinofluoran (10%);
3-diethylamino-6-methyl-7-anilinofluoran (80%), 3-N-propyl-N-methylamino-6-methyl-7-anilinofluoran (20%);
3-diethylamino-6-methyl-7-anilinofluoran (20%), 3-N-propyl-N-methylamino-6-methyl-7-anilinofluoran (80%);
3-diethylamino-6-methyl-7-anilinofluoran (10%), 3-N-propyl-N-methylamino-6-methyl-7-anilinofluoran (90%);
3-diethylamino-6-methyl-7-anilinofluoran (10%), 3-diethylamino-6-methyl-7-(3-tolyl)aminofluoran (90%);
3-diethylamino-6-methyl-7-anilinofluoran (20%), 3-diethylamino-6-methyl-7-(3-tolyl)aminofluoran (80%);
3-dibutylamino-6-methyl-7-anilinofluoran (90%), 3,3-bis(1-octyl-2-methylindol-3-yl)phthalide (10%);
3-dibutylamino-6-methyl-7-anilinofluoran (80%), 3,3-bis(1-octyl-2-methylindol-3-yl)phthalide (20%);
3-dibutylamino-6-methyl-7-anilinofluoran (90%), mixture of 2-phenyl-4-(4-diethylaminophenyl)-4(4-methoxyphenyl)-6-methyl-7-dimethylamino-3,1-benzoxazine and 2-phenyl-4-(4-diethylaminophenyl)-4-(4-methoxyphenyl)-8-methyl-7-dimethylamino-3,1-benzoxazine(10%);
3-dibutylamino-6-methyl-7-anilinofluoran (80%), mixture of 2-phenyl-4-(4-diethylaminophenyl)-4-(4-methoxyphenyl)-6-methyl-7-dimethylamino-3,1-benzoxazine and 2-phenyl-4-(4-diethylaminophenyl)-4-(4-methoxyphenyl)-8-methyl-7-dimethylamino-3,1-benzoxazine(20%);
3-dibutylamino-6-methyl-7-anilinofluoran (90%), 4,4'-[1-methylethylidene)bis(4,1-phenyleneoxy-4,2-quinazolinediyl)]bis[N,N-diethylbenzenamine] (10%); and
3-dibutylamino-6-methyl-7-anilinofluoran (80%), 4,4'-[1-methylethylidene)bis(4,1-phenyleneoxy-4,2-quinazolinediyl)]bis[N,N-diethylbenzenamine] (20%).

8. A heat sensitive recording material comprising a monophase solid solution according to claim 1 in combination with a developer, a dispersing medium and optionally another colour forming compound, a binder, a sensitiser, a filler, a lubricant or a stabiliser and mixtures thereof.

9. A pressure sensitive recording material comprising a monophase solid solution according to claim 1 in combination with other colour forming materials, a solvent, a developer, and optionally a diluent and a capsule wall material.

10. A monophase solid solution comprising two components A and B according to claim 3 obtained by recrystallization of a physical mixture of A and B from a suitable solvent.

11. A monophase solid solution comprising two components A and B according to claim 3 obtainable by the reaction two keto acids of formula (II) with a compound of formula (III):

Formula II

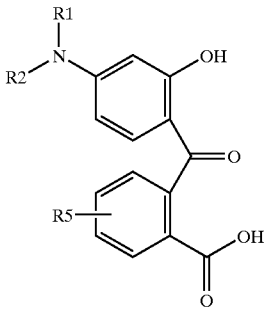

-continued

Formula III

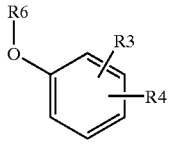

wherein,

R1 and R2 independently represent hydrogen; alkyl of 1–18 carbon atoms, a secondary alkyl with respect to the carbon atom bonded to the nitrogen atom of 3–13 carbon atoms; a cycloalkyl of 4–8 carbon atoms or a phenyl, both of which may be substituted by at least one substituent selected from the group consisting of halogen atoms and alkyls having 1–4 carbon atoms, an aralkyl of 7–10 carbon atoms; or R1 and R2, together with the adjacent nitrogen atom form a heterocyclic ring;

R3 is hydrogen; an alkyl of 1–4 carbon atoms; an alkoxy of 1–4 carbon atoms; a phenyl; a substituted phenyl or a halogen;

R4 is an alkyl group of 1–18 carbon atoms; a carboxyalkyl of 1–18 carbon atoms; a carboxycycloalkyl of 4–8 carbon atoms; an alkylamino of 1–18 carbon atoms; a cycloalkylamino of 4–8 carbon atoms; a dialkylamino or dicycloalkylamino; an arylamino; a substituted arylamino; an aralkylamino of 7–10 carbon atoms; a diaralkylamino;

R5 is an alkyl of 1–18 carbon atoms; a carboxy alkyl of 1–18 carbon atoms or a halogen; and R6 is hydrogen or alkyl of 1–4 carbon atoms.

12. A monophase solid solution according to claim 11 obtained by the reaction of mixed keto-acids of formula (II), derived from the reaction of compounds of formula (IV) with compounds of formula (V), together with the compounds of formula (III):

Formula IV

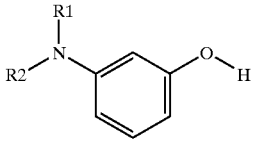

-continued

Formula V

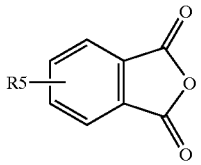

Formula III

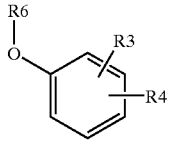

wherein

R1 and R2 independently represent hydrogen; alkyl of 1–18 carbon atoms, a secondary alkyl with respect to the carbon atom bonded to the nitrogen atom of 3–13 carbon atoms; a cycloalkyl of 4–8 carbon atoms or a phenyl, each of which may be substituted by at least one substituent selected from the group consisting of halogen atoms and alkyls having 1–4 carbon atoms, an aralkyl of 7–10 carbon atoms; or R1 and R2, together with the adjacent nitrogen atom form a heterocyclic ring;

R3 is hydrogen; an alkyl of 1–4 carbon atoms; an alkoxy of 1–4 carbon atoms; a phenyl; a substituted phenyl or a halogen;

R4 is an alkyl group of 1–18 carbon atoms; a carboxyalkyl of 1–18 carbon atoms; a carboxycycloalkyl of 4–8 carbon atoms; an alkylamino of 1–18 carbon atoms; a cycloalkylamino of 4–8 carbon atoms; a dialkylamino or dicycloalkylamino; an arylamino; a substituted arylamino; an aralkylamino of 7–10 carbon atoms; or a diaralkylamino;

R5 is an alkyl of 1–18 carbon atoms; a carboxy alkyl of 1–18 carbon atoms or a halogen; and R6 is hydrogen or alkyl of 1–4 carbon atoms.

* * * * *